US008360273B2

(12) United States Patent
Reinsel et al.

(10) Patent No.: US 8,360,273 B2
(45) Date of Patent: Jan. 29, 2013

(54) CUTLERY UTENSIL DISPENSER

(75) Inventors: Christopher M. Reinsel, Neenah, WI (US); Brian Durant, Kennesaw, GA (US); Stephen J. Drabant, Lawrenceville, GA (US); Thomas J. Steimer, Athens, GA (US)

(73) Assignee: Dixie Consumer Products LLC, Atlanta, GA (US)

( * ) Notice: Subject to any disclaimer, the term of this patent is extended or adjusted under 35 U.S.C. 154(b) by 1033 days.

(21) Appl. No.: 12/247,805

(22) Filed: Oct. 8, 2008

(65) Prior Publication Data

US 2010/0084418 A1 Apr. 8, 2010

(51) Int. Cl.

| | |
|---|---|
| ***G07F 11/00*** | (2006.01) |
| ***B65H 1/00*** | (2006.01) |
| ***B65H 3/44*** | (2006.01) |
| ***A47F 7/00*** | (2006.01) |

(52) U.S. Cl. ..... 221/131; 221/129; 221/97; 221/1; 221/133; 221/163; 221/124; 221/112; 221/258; 221/9; 211/70.1; 211/49.1

(58) Field of Classification Search ..... 221/129, 221/97, 131, 1, 133, 163, 124, 112, 258, 221/9; 211/70.1, 49.1

See application file for complete search history.

(56) References Cited

U.S. PATENT DOCUMENTS

| | | | |
|---|---|---|---|
| 592,105 | A | 10/1897 | Barnes |
| 925,485 | A | 6/1909 | Lafler |
| 999,837 | A | 8/1911 | Morris et al. |
| 1,146,447 | A | 7/1915 | Prommel |
| 1,259,927 | A | 3/1918 | Swift |
| 1,355,583 | A | 10/1920 | Zeidler et al. |
| 1,482,071 | A | 1/1924 | Duff et al. |
| 1,504,098 | A | 8/1924 | Cathey |
| 1,546,077 | A | 7/1925 | Hunter et al. |
| 1,547,151 | A | 7/1925 | Watling |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Written Opinion of the International Searching Authority for PCT/US2007/083922 of Nov. 17, 2008.

(Continued)

*Primary Examiner* — Gene O. Crawford
*Assistant Examiner* — Rakesh Kumar
(74) *Attorney, Agent, or Firm* — William W. Letson

(57) ABSTRACT

A cutlery utensil dispenser having at least one utensil compartment and a dispensing mechanism is disclosed. Each utensil compartment is so dimensioned and configured to house a stack of utensils. The dispensing mechanism includes a drive member in operable communication with at least one driven member, each driven member being associated with a respective one of the compartments. Actuation of the drive member causes simultaneous actuation of each driven member that causes a utensil to be dispensed from each compartment in repeatable succession one at a time. Also disclosed is a cutlery utensil dispenser having an electric motor in operable communication with the dispensing mechanism, and a controller in operable communication with the motor. The controller includes a processing circuit responsive to computer executable instructions which when executed on the processing circuit facilitates dispensing of a utensil from the utensil compartment by operation of the motor on command.

46 Claims, 17 Drawing Sheets

U.S. PATENT DOCUMENTS 1,577,302 A 3/1926 Schultz
1,610,001 A * 12/1926 Foster ..... 221/202
1,675,510 A * 7/1928 Nolan ..... 221/93
1,886,378 A * 11/1932 Dearsley ..... 221/236
2,053,828 A 9/1936 Harper
2,078,984 A 5/1937 Williamson
2,110,189 A 3/1938 Zeidler, Sr.
2,141,684 A 12/1938 Diemer
2,149,098 A 2/1939 Phinney
2,149,099 A 2/1939 Phinney et al.
2,188,573 A 1/1940 Longo
2,207,528 A 7/1940 Witt
2,239,196 A 4/1941 Lunvik
2,260,596 A 10/1941 Young
2,268,596 A 1/1942 Jerum
2,268,873 A 1/1942 Hopkins et al.
2,421,782 A 6/1947 Gibbs et al.
2,472,051 A 5/1949 Testi
2,571,668 A 10/1951 Booth et al.
2,577,344 A 12/1951 Masure
2,635,025 A 4/1953 Ziska
2,646,874 A 7/1953 Testi
2,671,555 A 3/1954 Shnitzler
2,692,691 A 10/1954 Harriss et al.
2,752,678 A 7/1956 Welch
2,868,344 A 1/1959 Shields
2,877,926 A 3/1959 Abbe
2,880,907 A 4/1959 Mainers
2,889,076 A 6/1959 Van Schie
2,911,127 A 11/1959 Driss et al.
2,924,357 A 2/1960 Kingsley et al.
2,946,431 A 7/1960 Nissen
2,954,948 A 10/1960 Johnson
2,965,262 A 12/1960 DuBois
3,083,879 A 4/1963 Coleman
3,095,114 A 6/1963 Tobias
3,100,842 A 8/1963 Tellefsen
3,114,475 A 12/1963 Etes
3,132,765 A 5/1964 Florendo
3,146,908 A * 9/1964 Perri et al. ..... 221/124
3,163,327 A 12/1964 Maxwell
3,263,860 A 8/1966 Haas
3,300,087 A 1/1967 Kuypers
3,313,452 A 4/1967 Katz
3,334,784 A 8/1967 Morrison
3,371,821 A 3/1968 Abood et al.
3,407,927 A 10/1968 Jones
3,426,941 A 2/1969 Hovekamp
3,472,421 A 10/1969 Bailer
3,499,538 A 3/1970 Sherard
3,558,006 A 1/1971 Redmond et al.
3,587,922 A 6/1971 Oriti
3,680,736 A 8/1972 Viessmann
3,786,959 A 1/1974 Greb et al.
4,091,915 A * 5/1978 Claasen ..... 198/389
4,134,519 A 1/1979 Barnett et al.
4,308,974 A 1/1982 Jones
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
4,610,087 A 9/1986 Mickelson et al.
4,614,004 A 9/1986 Oshida
4,662,536 A 5/1987 Powers
4,691,811 A 9/1987 Arakawa et al.
4,697,673 A 10/1987 Omata
4,715,514 A * 12/1987 Vidondo ..... 221/258
4,789,064 A 12/1988 Segal
4,896,792 A 1/1990 Marchand
4,973,037 A 11/1990 Holbrook
4,986,442 A 1/1991 Hinterreiter
5,080,257 A * 1/1992 Carnisio ..... 221/113
5,127,546 A 7/1992 Chen
5,131,586 A 7/1992 Capy
5,191,997 A 3/1993 Squitieri
5,211,267 A 5/1993 Clark
5,249,705 A 10/1993 Gates
D342,648 S 12/1993 Cautereels et al.
5,269,397 A 12/1993 Kawamoto et al.
2,340,561 A 2/1994 Randolph
5,364,016 A 11/1994 Capy et al.
5,413,317 A 5/1995 Spoerre
5,449,054 A 9/1995 Wiese et al.
5,460,252 A 10/1995 Kosugi et al.
5,469,688 A 11/1995 Dunbar et al.
5,497,863 A 3/1996 Schmidt et al.
5,509,522 A 4/1996 Laidlaw
5,542,508 A 8/1996 Van Erden et al.
5,564,594 A 10/1996 Monfredo
5,586,685 A 12/1996 Dorner et al.
5,605,208 A 2/1997 Friedrichsen et al.
5,660,252 A 8/1997 Lafon
5,904,250 A 5/1999 De Schutter
5,921,408 A 7/1999 Groenewold et al.
5,961,021 A * 10/1999 Koike et al. ..... 225/103
6,023,913 A 2/2000 Gray et al.
6,047,830 A 4/2000 Chang
6,202,891 B1 3/2001 Mark
6,250,498 B1 6/2001 Lovejoy
6,298,960 B1 10/2001 Derr
6,336,568 B1 * 1/2002 Tucker et al. ..... 221/131
6,378,729 B1 * 4/2002 Kodama ..... 221/196
6,626,633 B2 9/2003 Jendzurski et al.
6,651,841 B2 11/2003 Tsuchida
D492,549 S 7/2004 Welch
D493,337 S 7/2004 Welch
6,763,972 B2 7/2004 Graupner
6,786,357 B2 * 9/2004 Renard ..... 221/197
6,832,694 B2 12/2004 Goeking et al.
6,837,028 B1 1/2005 Miano et al.
6,840,353 B2 1/2005 Arisaka
6,945,427 B2 9/2005 Hieb
6,972,033 B2 12/2005 McNicholas
6,976,348 B1 12/2005 Miano et al.
7,076,932 B2 7/2006 Rubin
7,210,279 B1 5/2007 Ahmed et al.
7,322,172 B2 * 1/2008 Hoffman et al. ..... 53/586
7,412,808 B2 8/2008 Lavi
D591,104 S 4/2009 Oakes
7,513,089 B2 4/2009 Rubin
7,516,831 B2 * 4/2009 Chang ..... 194/347
7,520,247 B2 4/2009 Rutledge
2002/0112445 A1 * 8/2002 Scaduto ..... 53/167
2003/0015824 A1 1/2003 Forbes et al.
2003/0146061 A1 8/2003 Tournier
2004/0045398 A1 3/2004 Hayashi
2004/0045860 A1 3/2004 Edgerly et al.
2004/0089670 A1 * 5/2004 Goeking et al. ..... 221/123
2005/0082307 A1 4/2005 Tucker
2005/0155229 A1 7/2005 Lee
2006/0000190 A1 1/2006 Behnke et al.
2007/0108141 A1 5/2007 Smith et al.
2007/0131705 A1 * 6/2007 Behravesh et al. ..... 221/130
2007/0193968 A1 * 8/2007 Smith et al. ..... 211/70.7
2008/0121650 A1 * 5/2008 Smith ..... 221/129
2008/0128445 A1 * 6/2008 Huang et al. ..... 221/7
2010/0147869 A1 6/2010 Iliffe et al.
2011/0180562 A1 * 7/2011 Reinsel et al. ..... 221/133
2011/0226797 A1 9/2011 Reinsel et al.
2011/0296693 A1 12/2011 Oakes

FOREIGN PATENT DOCUMENTS

DE 7033238 U 11/1970
DE 7127677 U 11/1971
DE 3151268 7/1983
DE 4139938 A1 6/1993
DE 9316566 U1 1/1994
DE 19906369 C1 2/2000
DE 202005013647 U1 7/2006
EP 0856272 A3 1/1999
EP 1022107 A1 7/2000
EP 1217923 B1 9/2003
EP 1358827 11/2003
EP 1213985 B1 6/2004
EP 1514497 A1 3/2005
EP 1719438 A1 11/2006

| | | | |
|---|---|---|---|
| EP | 1864596 | A2 | 12/2007 |
| JP | 08-047440 | | 2/1996 |
| JP | 2007-319493 | | 12/2007 |
| KR | 20-1991-0008085 | | 10/1991 |
| WO | 01/05280 | A1 | 1/2001 |
| WO | 01/05281 | A1 | 1/2001 |
| WO | 01/68492 | A1 | 9/2001 |
| WO | 2004/028309 | A1 | 4/2004 |
| WO | 2007/049982 | A1 | 5/2007 |
| WO | 2007/124606 | A1 | 11/2007 |
| WO | 2008/058187 | A2 | 5/2008 |

OTHER PUBLICATIONS

Office Action for U.S. Appl. No. 12/349,203 mailed Jun. 15, 2011.
Peel Adhesion for Single Coated Pressure-Sensitive Tapes 180 Angle, Aug. 1989, pp. 21-22.
Tack Rolling Ball, Aug. 1989, pp. 29-30.
Holding Power of Pressure-Sensitive Tape, Aug. 1989, pp. 31-33.
European Search Report for 06009258.2, mailed Jul. 24, 2006, five pages, Munich, Germany.
Written Opinion for PCT/US07/83752, mailed Mar. 11, 2008, six pages, European Patent Office, Munich, Germany.
International Search Report and Written Opinion for PCT/US2009/059915, mailed Feb. 3, 2010, 13 pages, European Patent Office, Munich, Germany.
Office Action for U.S. Appl. No. 11/415,836, filed May 2, 2006.
Office Actions for U.S. Appl. 11/556,808, filed Nov. 6, 2006.
Office Actions for U.S. Appl. No. 11/936,401, filed Nov. 7, 2007.
European Patent Search Report EP 08 01 4387, Oct. 30, 2008.
PCT International Search Report PCT/US2007/083922, Nov. 17, 2008.
PCT International Search Report PCT/US2007/083752, Mar. 11, 2008.
PCT International Search Report PCT/US2007/083922, Jul. 8, 2008.

* cited by examiner

CUTLERY UTENSIL DISPENSER

BACKGROUND OF THE INVENTION

The present disclosure relates generally to a cutlery utensil dispenser, and particularly to a multi-stack cutlery utensil dispenser.

Eating facilities often provide cutlery utensils in dispensing bins, where all customers place their hands into the bins in order to retrieve a knife, fork, spoon or spork. While such arrangements provide for economical dispensing of cutlery utensils, as opposed to sets of utensils being separately wrapped in plastic sleeves, the open air bins are not very hygienic, and can spread hand-carried bacteria and the like to other utensils in the bin or potentially to another customer.

In an attempt to address concerns relating to the dispensing of hygienic cutlery utensils, enclosed dispensers have been employed where a stack of cutlery utensils are placed in a utensil compartment and dispensed one at a time on command by operation of a dispensing lever. Such arrangements may be suitable for their intended purpose, but are also limited by the capacity of utensils they are capable of holding. One remedy to such a deficiency may be to simply make the utensil compartment taller, thereby enabling multiple stacks of pre-measured and pre-assembled cutlery utensils to be placed one on top of the other. However, such a dispenser would be quite tall, would require refilling from a relatively high level, and would require each of the separate stacks to be properly aligned one on top of the other during refilling so that the cutlery utensils are properly aligned for dispensing. In view of these and other deficiencies, there is a need in the art for an improved cutlery utensil dispenser.

BRIEF DESCRIPTION OF THE INVENTION

An embodiment of the invention includes a cutlery utensil dispenser having a plurality of N utensil compartments and a dispensing mechanism. Each of the utensil compartments are so dimensioned and configured to house a stack of utensils, each compartment having a dispensing opening through which a dispensed utensil passes. The dispensing mechanism includes a drive member in operable communication with a plurality of N driven members, each driven member being associated with a respective one of the compartments, each driven member having a dispensing arm that facilitates the dispensing of a utensil from the associated compartment. Actuation of the drive member causes simultaneous actuation of each driven member that causes a utensil to be dispensed from each of the plurality of compartments in repeatable succession one at a time.

Another embodiment of the invention includes a cutlery utensil dispenser for dispensing cutlery utensils. The dispenser includes a utensil compartment so dimensioned and configured to house a stack of cutlery utensils, a dispensing mechanism disposed and configured to facilitate dispensing of a utensil from the utensil compartment on command, means for providing electrical power, an electric motor in operable communication with the power means and the dispensing mechanism, and a controller in operable communication with the motor. The controller includes a processing circuit responsive to computer executable instructions which when executed by the processing circuit facilitates dispensing of a utensil from the utensil compartment by operation of the motor on command.

Another embodiment of the invention includes a cutlery utensil dispenser for dispensing cutlery utensils. The dispenser includes a utensil compartment, a dispensing mechanism in operable communication with the utensil compartment, an electric motor in operable communication with the dispensing mechanism, and a controller in operable communication with the motor. The controller includes a processing circuit responsive to computer executable instructions which when executed on the processing circuit facilitates dispensing of a utensil from the utensil compartment by operation of the motor and the dispensing mechanism on command.

Another embodiment of the invention includes a method of automatically dispensing a single piece of cutlery utensil from an electronically controlled and motor driven cutlery utensil dispenser. A sensor is used to sense a presence of a piece of cutlery at a dispensing tray of the dispenser and a single piece of cutlery is automatically dispensed to the dispensing tray for subsequent removal by a user in response to a piece of cutlery not being present at the dispensing tray. The sensor is used to sense a presence of the dispensed cutlery at the dispensing tray prior to removal by a user, and in response to the sensor sensing removal of the dispensed cutlery from the dispensing tray, a next-to-be-dispensed single piece of cutlery is dispensed to the dispensing tray for subsequent removal by a user.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention, as shown and described by the various figures and accompanying text, provides a cutlery utensil dispenser configured for dispensing utensils one at a time in succession from a plurality of utensil compartments each housing a stack of utensils, and a dispensing method applicable thereto. While the embodiments described herein depict a fork as an example utensil, it will be appreciated that the disclosed invention is also applicable to other cutlery utensils, such as knives, spoons and sporks, for example. The stack of utensils may be made from any type of material, such as plastic, metal, wood, or plastic-coated compressed paper, for example.

Figure 1:
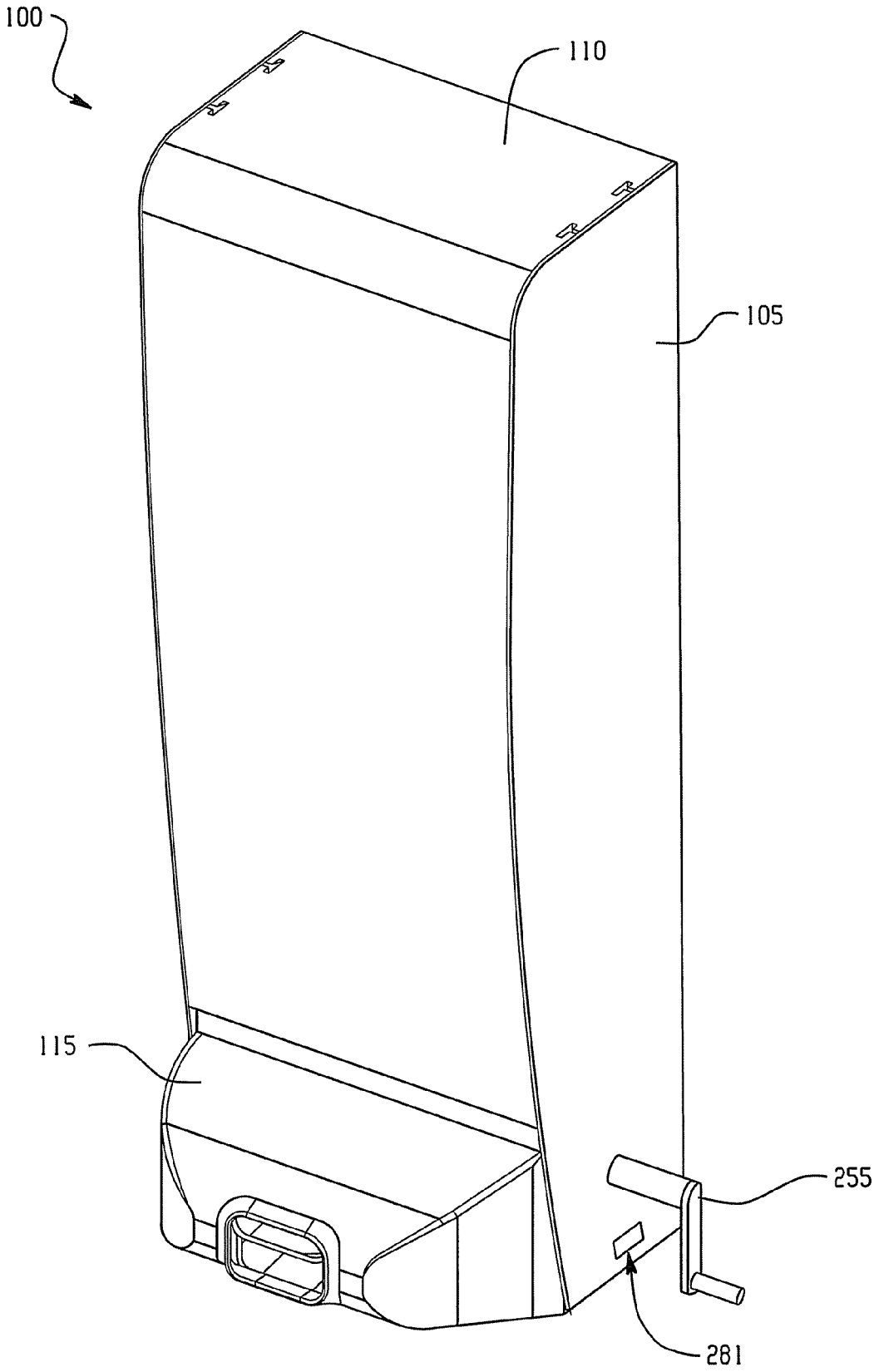
FIG. 1 depicts in isometric view a cutlery utensil dispenser having a dispensing mechanism in accordance with an embodiment of the invention.
Figure 2:
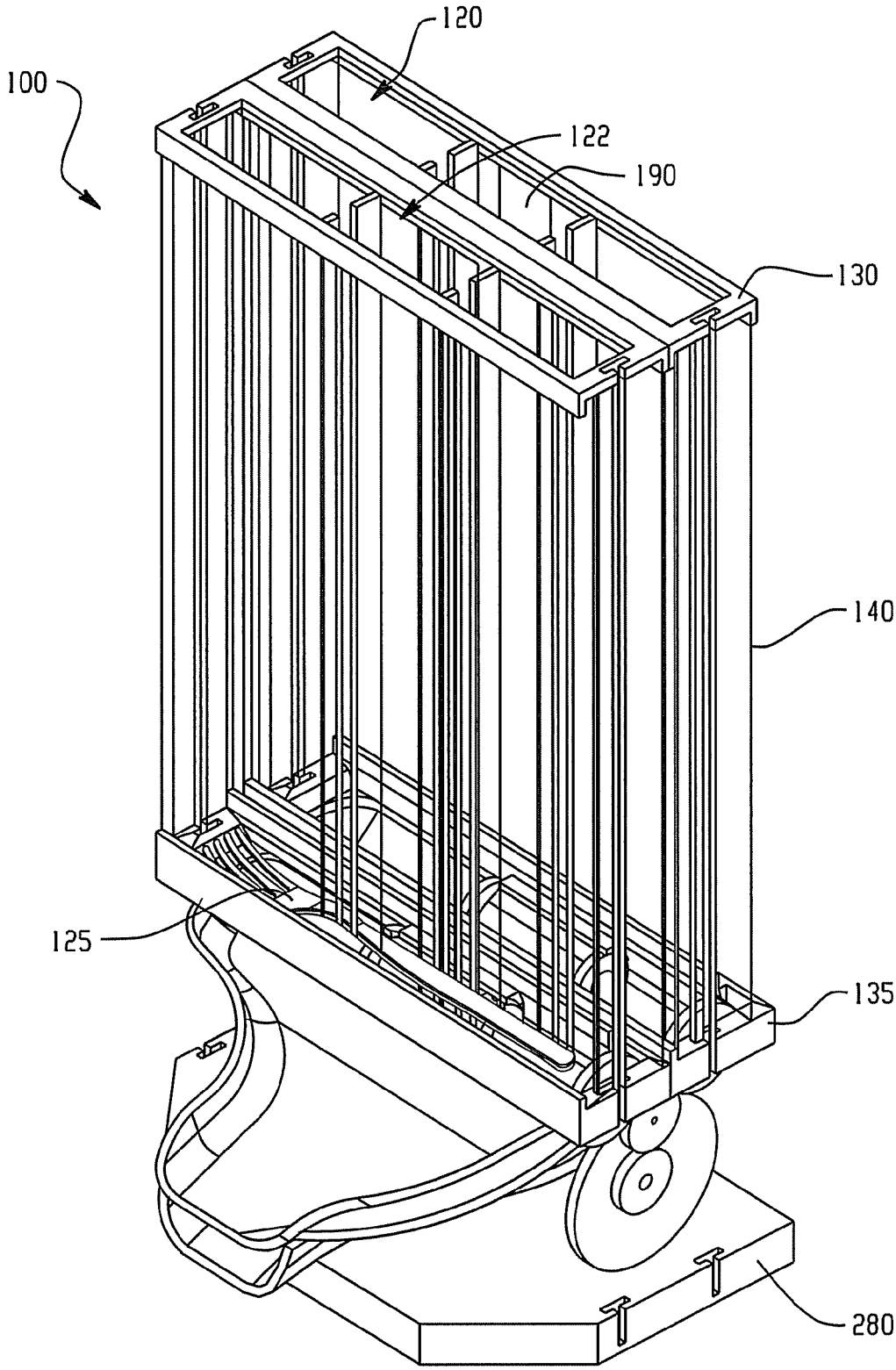
FIG. 2 depicts in isometric view the dispenser of FIG. 1 with cover removed to show internal components of the dispenser.

FIGS. 1 and 2 depict an embodiment of a cutlery utensil dispenser 100 with and without, respectively, side walls 105, a housing cover 110, and a tray cover 115. Referring more specifically to FIG. 2, the dispenser 100 includes a plurality of N utensil compartments 120, 122 having suitable dimensions and configuration to house a stack of utensils 125 in each. As depicted in FIG. 2, the value of "N" is "2". However, as will be appreciated by the discussion herein, the value of "N" may be any integer suitable for the intended purpose disclosed herein, such as 2, 3, 4 or 5 for example. While only one utensil 125 (fork illustrated) is depicted in FIG. 2, it will be appreciated that a stack of utensils 125 would result by placing and/or nesting one on top of another, with one stack being placed within each rectangular shaped compartment 120, 122.

In an embodiment, each compartment 120, 122 has a top frame 130, a bottom frame 135, and side supports 140 for retaining the stack of utensils 125. The bottom frame 135 has a dispensing opening 145 (best seen by referring to FIG. 3) through which a dispensed utensil 125 passes.

Figure 3:
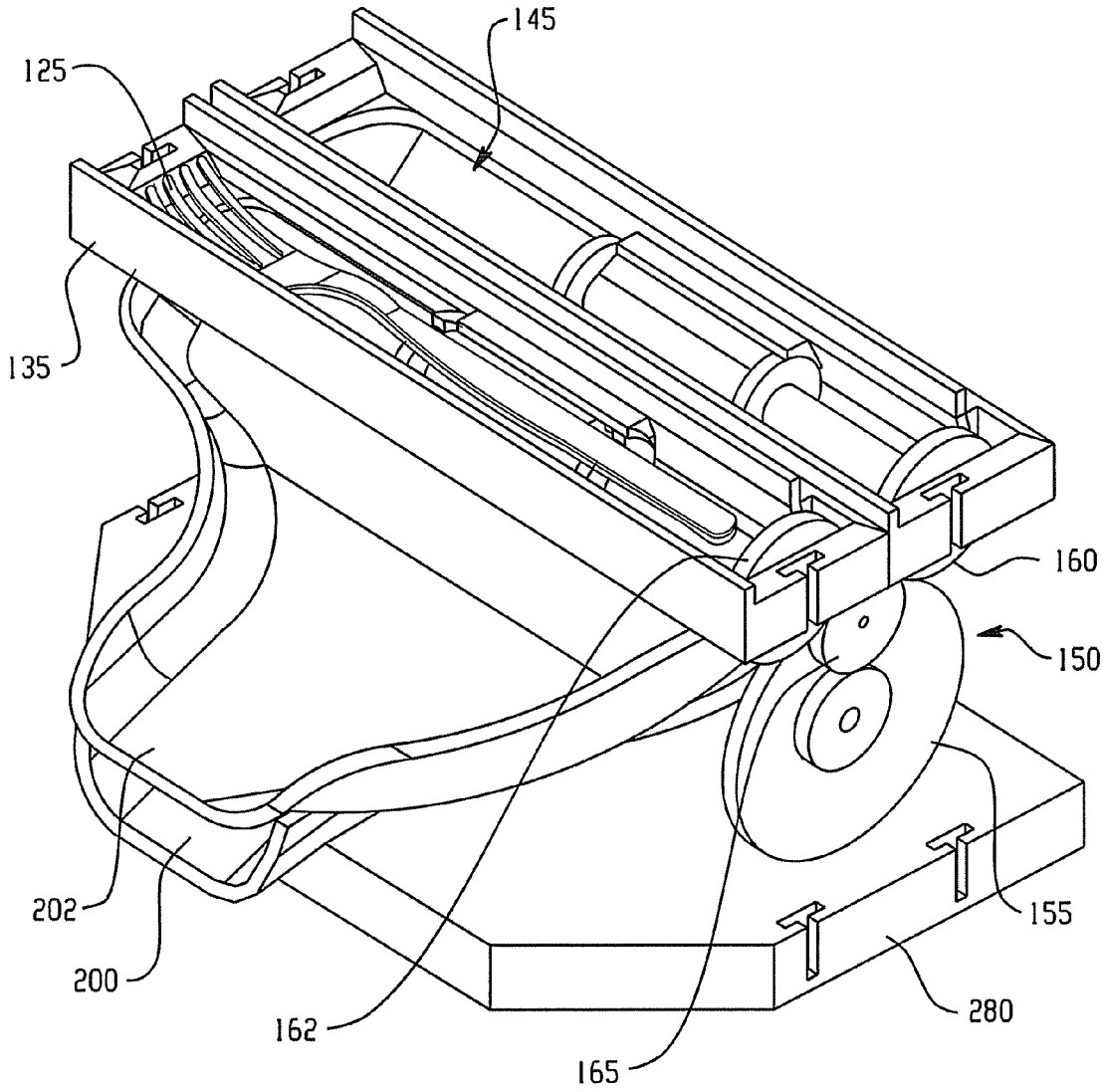
FIG. 3 depicts in isometric view portions of the internal components of FIG. 2 in greater detail.
Figure 4:
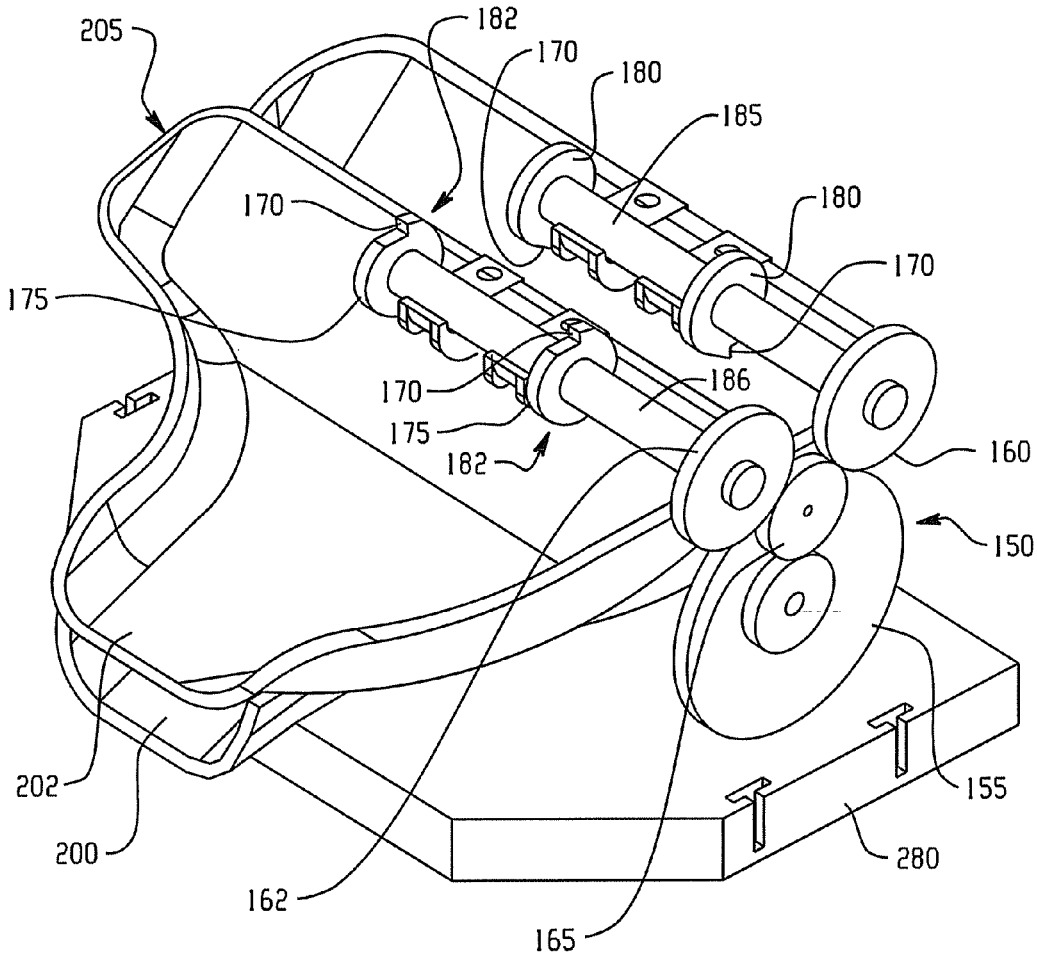
FIG. 4 depicts in isometric view portions of the internal components of FIG. 3 in greater detail.
Figure 5:
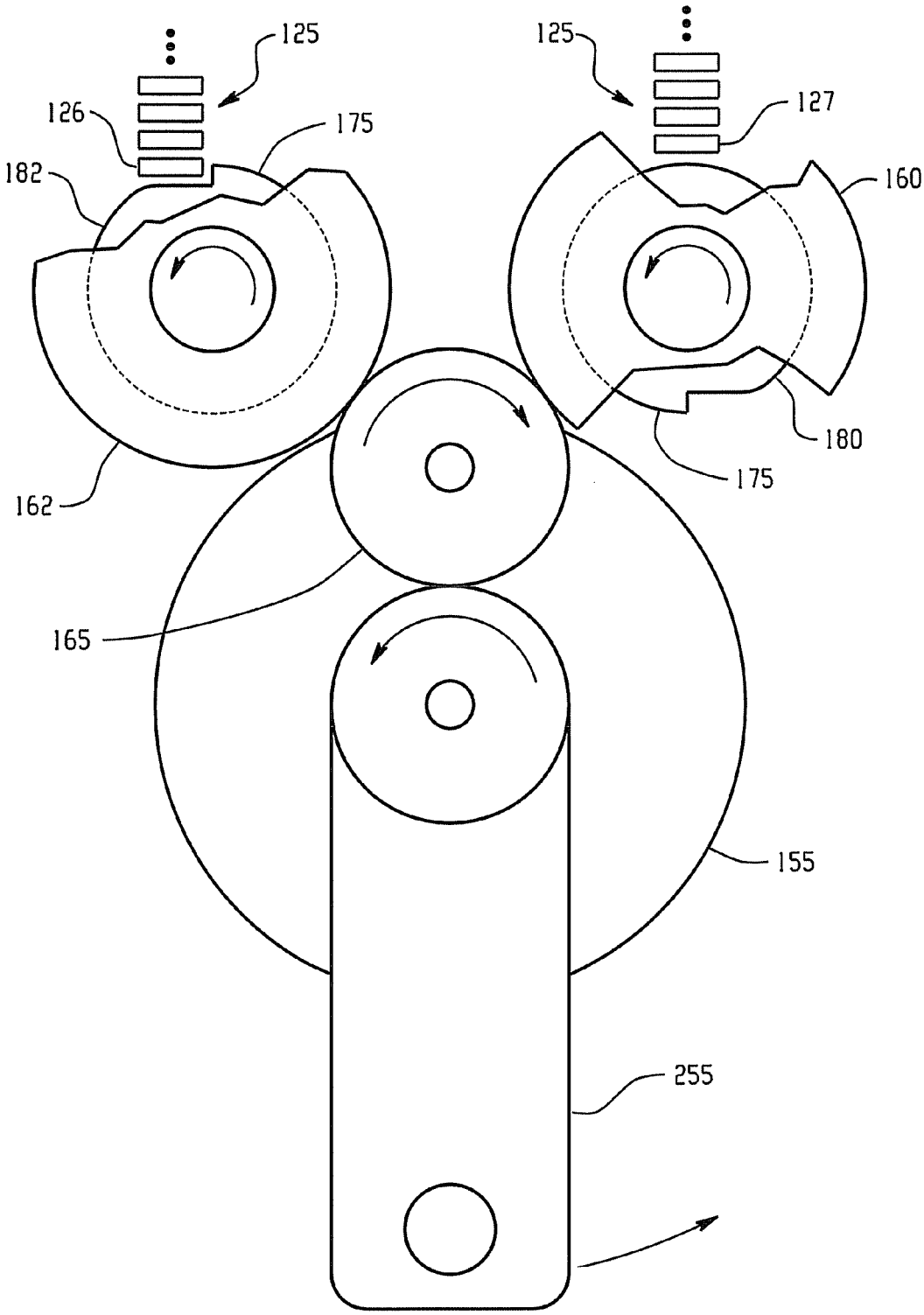
FIG. 5 depicts in side view portions of the dispensing mechanism in accordance with an embodiment of the invention.

Reference is now made to FIGS. 3 and 4, where FIG. 3 depicts the elements of FIG. 2 with compartments 120, 122 removed, and FIG. 4 depicts the elements of FIG. 3 with each bottom frame 135 and utensil 125 removed. As depicted, an embodiment of dispenser 100 (FIG. 1) includes a dispensing mechanism 150 having a drive member 155 in operable communication with a plurality of N driven members 160, 162 by way of an idler 165, each driven member 160, 162 being associated with a respective one of the compartments 120, 122. Each driven member 160, 162 includes a dispensing arm 170 formed on a cam surface 175 of associated cams 180, 182 that facilitates the dispensing of a utensil 125 from the associated compartment 120, 122. Cams 180, 182 of associated driven members 160, 162 are coupled by a respective shaft 185, 186. As illustrated, there are two cams 180, 182 for each driven member 160, 162, however, the number of cams can be any number suitable for the purposes disclosed herein. The dispensing arms 170 associated with each of the plurality of cams 182 on driven member 162 (and similarly for dispensing arms 170 associated with each of the plurality of cams 180 on driven member 160) may be staggered one relative to the other in order to accommodate the profile of the associated utensil 125 and to maintain utensil alignment during dispensing. The cam surface 175 of each cam 180, 182 has a spiral-like profile with a step (also depicted by reference numeral 170) that defines the associated dispensing arm 170. The dispensing arms 170 associated with each driven member 160, 162 engage with a next-to-be-dispensed utensil 126 (depicted in FIG. 5 and also depicted generally by the utensil 125 illustrated in FIG. 3) located proximate the associated dispensing opening 145. Referring now to FIG. 5, which depicts a cutaway side view of drive member 155, driven members 160, 162, idler 165, and cams 180, 182, the spiral-like profile of cam surface 175 is configured to retain the next-in-line utensil 127, while dispensing the next-to-be-dispensed utensil 126, to prevent out-of-sequence dispensing of the utensils.

In an embodiment, drive member 155, driven members 160, 162 and idler 165 are configured as gears (while not specifically illustrated, gear teeth would be disposed on the outer periphery of the various gear members 155, 160, 162, 165, and would mesh with each other according to standard practices), such that driven members 160, 162 are gear-driven by actuation of drive member 155. As such, actuation of the drive member 155 in the counterclockwise (CCW) direction, with respect to the view of FIG. 5, causes simultaneous actuation of each driven member 160, 162 in the CCW direction through idler 165 rotating in the clockwise (CW) direction, which causes a next-to-be-dispensed utensil 126 and then a next-in-line utensil 127 to be dispensed from each of the plurality of utensil compartments 120, 122 in repeatable succession one at a time. In an embodiment, the gear ratios of drive member 155, driven members 160, 162 and idler 165, are such that one rotation of drive member 155 results in a half rotation of driven members 160, 162 and cams 180, 182. For proper sequenced dispensing in a dispenser 100 having two utensil compartments 120, 122, the dispensing arms 170 associated with driven member 160 need to be 180-degrees out of phase with the dispensing arms 170 associated with driven member 162, as illustrated in FIGS. 4 and 5.

As discussed above and illustrated in FIGS. 4 and 5, one revolution of the drive member 155 will result in a half revolution of each driven member 160, 162, causing dispensing arms 170 to increment one-half revolution for each one revolution of drive member 155, thereby resulting in alternating dispensing of utensils from the two stacks 125 for uniform depletion of utensil compartments 120, 122. A more general relation, however, between the fractional revolution of driven members 160, 162 and drive member 155 may be represented by the ratio $(1/N)^x$, where N is the number of utensil compartments 120, 122 (also the number of driven members 160, 162) and x is a positive integer greater than zero. For a configuration where N=2 and x=2 (in comparison, FIG. 5 depicts a configuration where N=2 and x=1), one revolution of drive member 155 would result in ¼ revolution of each driven member 160, 162, which would require two dispensing arms 170 spaced 180-degrees apart, per cam 180, 182, with the set of dispensing arms 170 on cam 182 being 90-degrees out of phase with the set of dispensing arms 170 on cam 180. More generally, the dispensing arms 170 of each driven member are displaced $(1/N)^x$ intervals of revolution with respect to each other. As can be seen from the foregoing discussion, a variety of gear ratios and numbers of dispensing arms per cam may be employed without departing from the scope of the disclosed invention, all of which are contemplated herein.

With reference back to FIG. 2, an embodiment of dispenser 100 has the plurality of N utensil compartments 120, 122 so dimensioned and configured to house the same type of utensil, and are disposed one adjacent another such that the utensils 125 within each stack of utensils (generally referred to by reference numerals 126 and 126 in FIG. 5) are oriented longitudinally parallel with each other. That is, the utensils 125 are lengthwise aligned with the longitudinal axes of top and bottom frames 130, 135. Side openings 190 in each of the plurality of utensil compartments 120, 122 provide access to the interior of each of the compartments, thereby facilitating loading of each compartment with a stack of utensils, which typically have some form of bonding strip that needs to be removed once loaded.

As discussed above and with reference now to FIGS. 3-5, one CCW rotation of drive member 155 causes one-half CCW rotation of driven members 160, 162 and one-half CCW rotation of associated cams 180, 182, which in turn causes utensil 126 to be pushed off of cam 182 on the first full rotation of drive member 155, and utensil 127 to be pushed off of the cam 180 on the second full rotation of drive member 155. Under the influence of gravity, a dislodged utensil 125 falls into a respective one of a plurality of dispensing trays 200, 202, with each tray being associated with a respective one of the compartments 120, 122. Each tray 200, 202 has a receiving end 205 disposed to receive a dispensed utensil 125 from only the associated compartment (compartment 120 dispensing into tray 200, and compartment 122 dispensing into tray 202), and a dispensing end 210 (FIG. 6).

Figure 6:
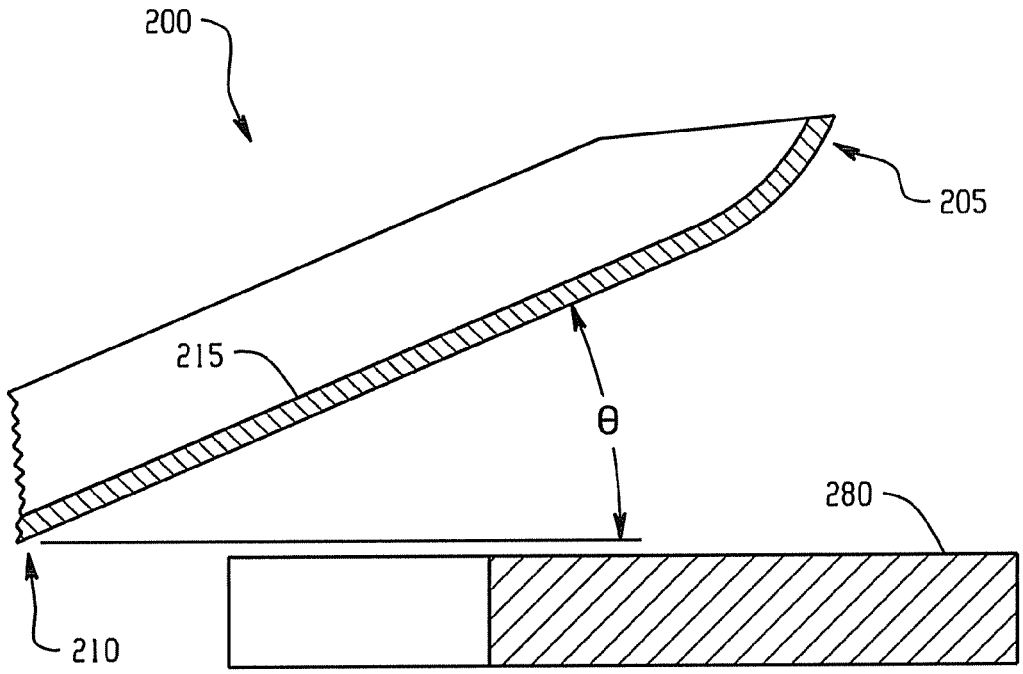
FIG. 6 depicts in cross section side view a dispensing tray in accordance with an embodiment of the invention.

Referring now to FIG. 6, which depicts a section cut side view of tray 200 (also applicable to tray 202 for discussion purposes) in an orientation representative of an in-use dispenser (see orientation with respect to base 280), each tray 200, 202 has an angled dispensing surface 215 having angle θ such that a dispensed utensil slides under the influence of gravity from the receiving end 205 to the dispensing end 210.

Figure 7A:
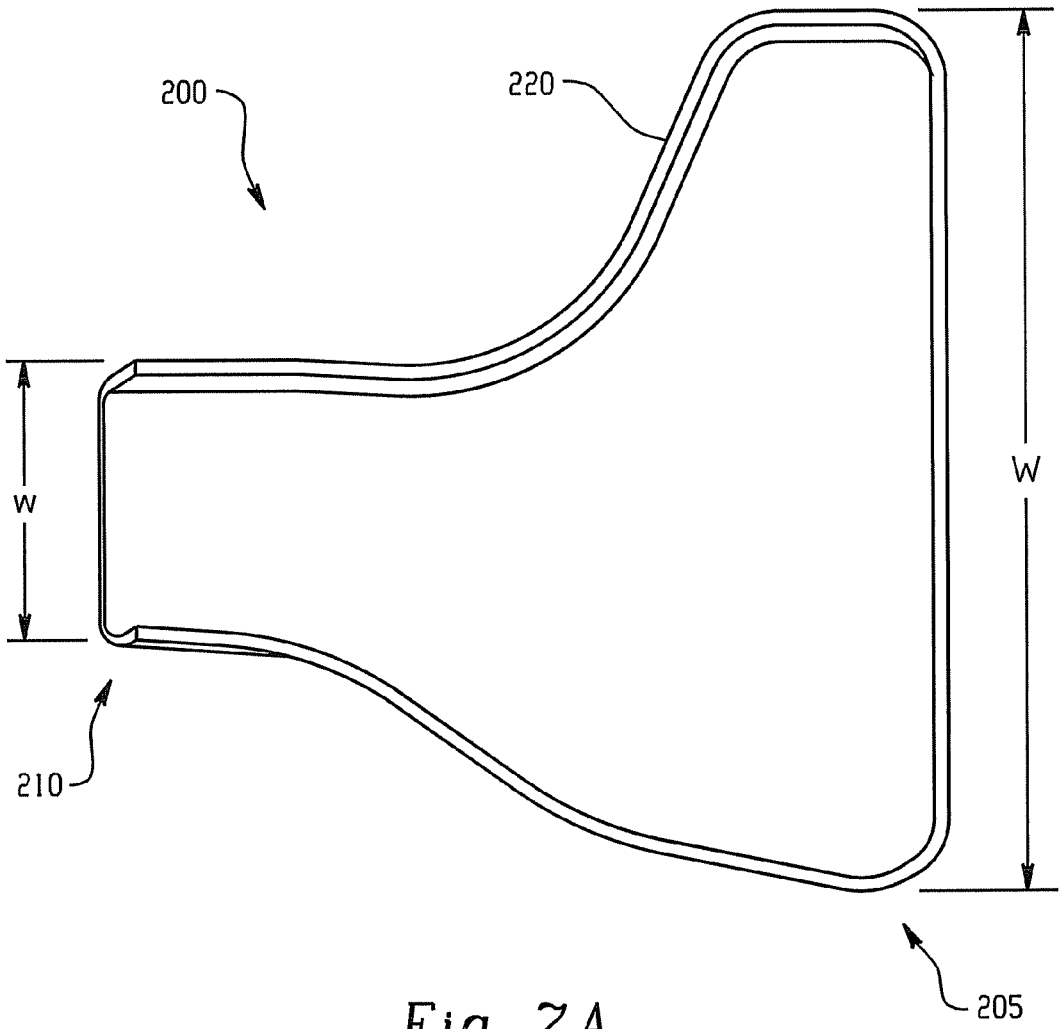
FIGS. 7A and 7B depict plan views of dispensing trays in accordance with an embodiment of the invention, with FIG. 7B depicting a dispensed cutlery utensil in various stages of dispensing.
Figure 7B:
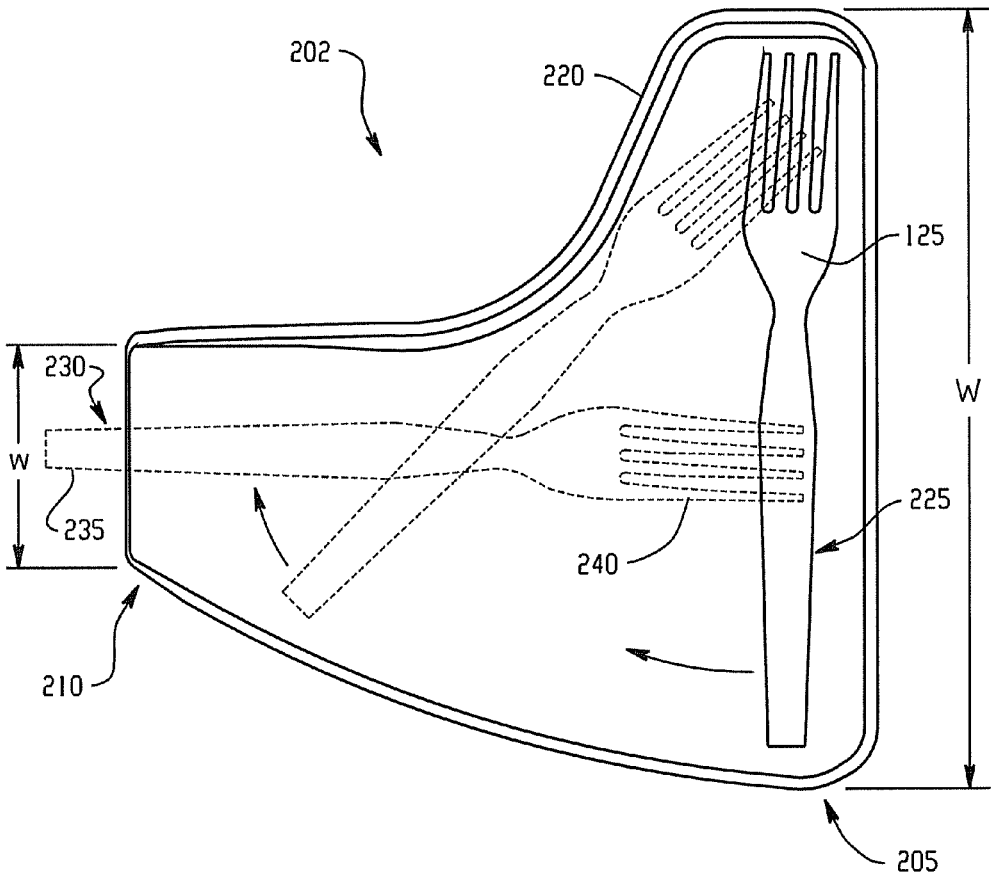

As illustrated in FIGS. 7A and 7B, which depict plan views of trays 200, 202, respectively, the receiving end 205 of each tray has a width "W" that is wider than the width "ω" of the respective dispensing end 210, with side walls 220 that engage a dispensed utensil 125 to cause the dispensed utensil to rotate from a first orientation 225 to a second orientation 230 as the dispensed utensil slides under the influence of gravity down dispensing surface 215 (see transition stages of utensil 125 shown in phantom in FIG. 7B). As illustrated in FIG. 7B, the second orientation 230 of utensil 125 presents the holding portion 235 of the utensil to an end user, as opposed to presenting the utility portion 240 of the utensil. In an embodiment, the degree of rotation of dispensed utensil 125 from the first orientation 225 to the second orientation 230 is 90-degrees.

As indicated by the illustrations of trays 200, 202 in FIGS. 7A and 7B, each dispensing tray in the plurality N of dispensing trays may have a slightly different profile in order to accommodate the position of the associated receiving end 205 relative to the associated dispensing opening 145 (FIG. 3) of the associated utensil compartment 120, 122. However, each dispensing tray will include a side wall 220 that facilitates rotation of the dispensed utensil 125 is it moves under the influence of gravity down dispensing surface 215 (FIG. 6). All such tray profiles are considered within the scope of the invention disclosed herein.

Figure 8:
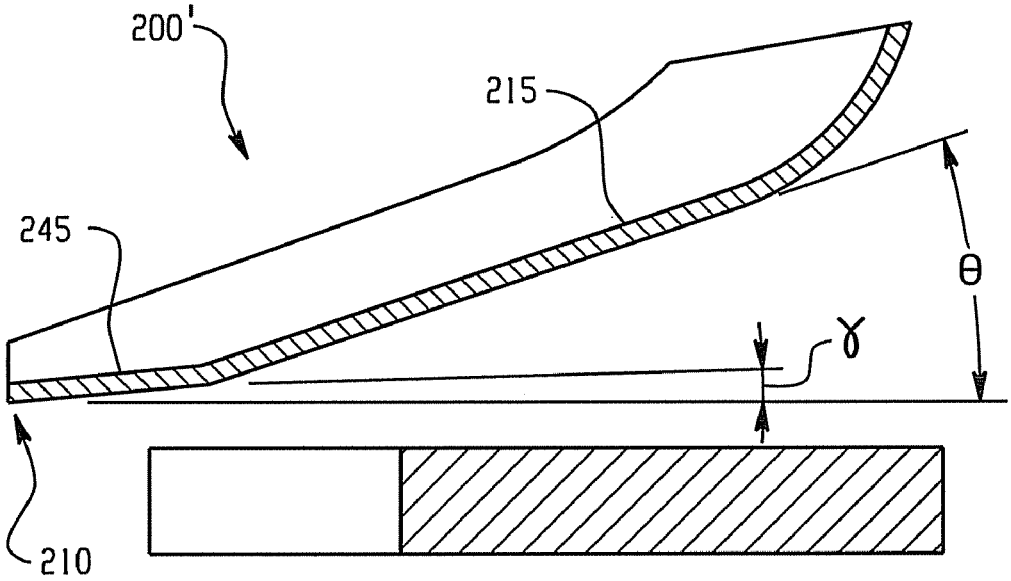
FIGS. 8 and 9 depict in cross section side view alternative dispensing trays to that of FIG. 6.

In an alternative embodiment, and with reference now to FIG. 8, which depicts a section cut side view of an alternative tray 200' of tray 200 (also applicable to an alternative of tray 202), each tray may further include a second dispensing surface 245 proximate the dispensing end 210, the second dispensing surface 245 having a flatter surface, represented by angle γ, than the angled dispensing surface 215, represented by angle θ, such that a dispensed utensil decelerates to a stop as it slides under the influence of gravity from the angled dispensing surface 215 to the flatter surface 245.

Figure 9:
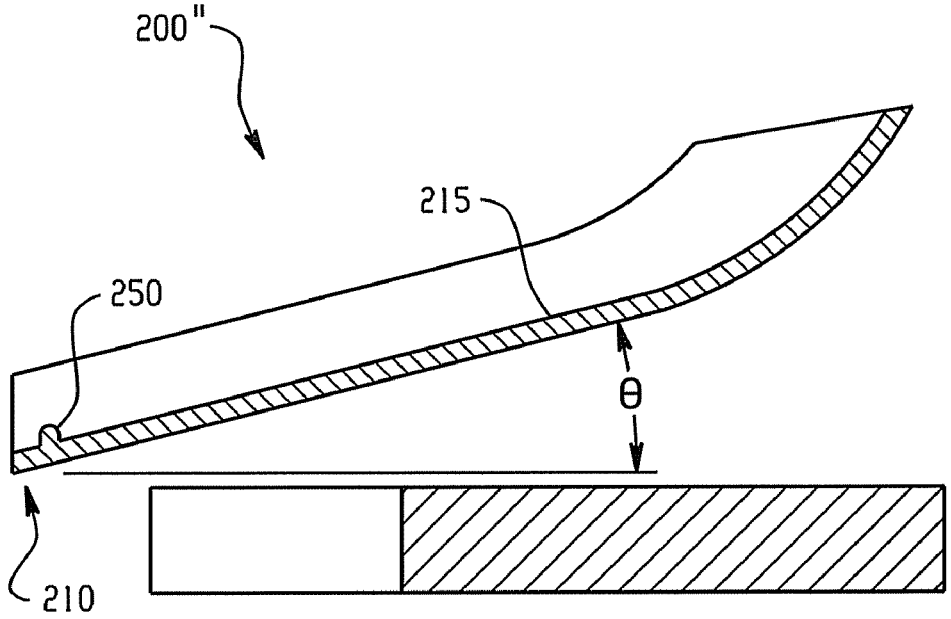

In a further alternative embodiment, and with reference now to FIG. 9, which depicts a section cut side view of an alternative tray 200" of tray 200 (also applicable to an alternative of tray 202), each tray may further include a ridge 250 (exaggerated in size for illustration purposes) proximate the dispensing end 210 such that a dispensed utensil stops sliding under the influence of gravity in response to impinging the ridge 250.

Referring back to FIGS. 1, 2 and 5, an embodiment of dispenser 100 includes a manually actuatable lever 255 fixedly coupled to the drive member 155, wherein repeated rotation of the lever 255 causes repeated rotation of the drive member 155, which in turn causes a utensil 125 to be dispensed from each of the plurality of compartments 120, 122 in succession one at a time.

Figure 10:
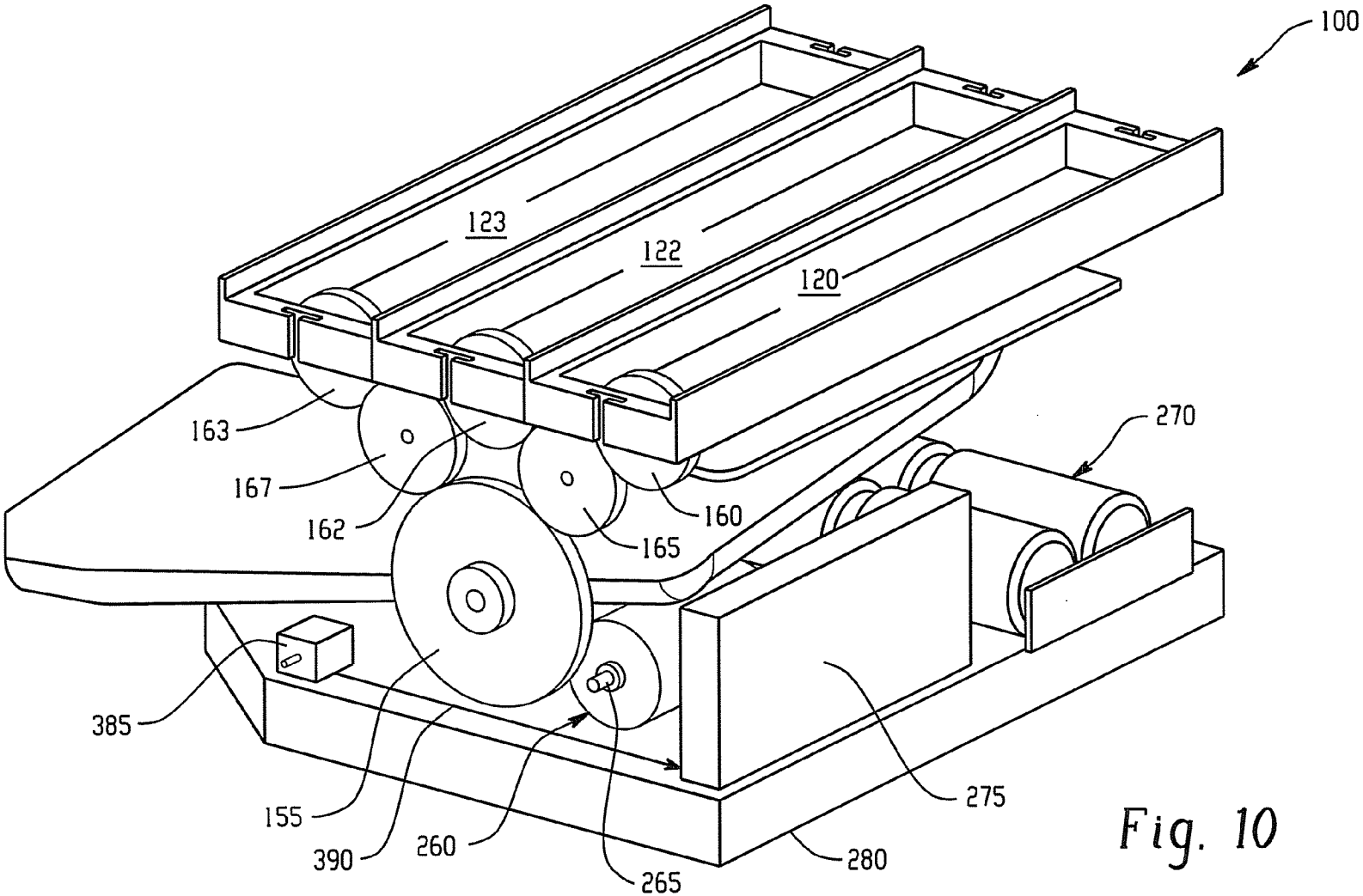
FIG. 10 depicts in isometric view an alternative dispensing mechanism to that of FIGS. 2-5 and in accordance with an embodiment of the invention.

With reference to FIG. 10 (and with periodic reference to FIGS. 1 and 2), and as discussed above, an embodiment of the dispenser 100 may include more than two utensil compartments and two driven members, such as the three utensil compartments 120, 122, 123 and three driven members 160, 162, 163 depicted in FIG. 10. To drive the three driven members 160, 162, 163 simultaneously, two idlers 165, 167 are employed. An embodiment also includes a motor 260 in place of the manually actuatable lever 255. The motor 260 is in operable communication with the drive member 155 via a spindle gear 265. As with the actuation of the lever 255, repeated actuation of the motor 260 causes a utensil 125 to be dispensed from each of the plurality of compartments 120, 122, 123 in succession one at a time, with one actuation of the motor 260 causing one increment of rotation of the driven members 160, 162, 163. With three driven members, as depicted in FIG. 10, one increment of rotation of the driven members is 1/N or ⅓ rotation.

As an aside, a dispenser 100 employing a manually actuatable lever 255 may have the gear structure of the drive member, driven members and idler configured such that one revolution of the lever 255 causes one increment of revolution (1/N revolution) of the driven members, which is a convenient and natural mode of manual operation for an end user. On the other hand, a dispenser 100 employing a motor 260 may have the gear structure of the drive member, driven members and idler configured such that any defined degree of rotation of the motor causes one increment of revolution (1/N revolution) of the driven members, where the defined degree of rotation of the motor 260 is a matter of design choice.

With reference still to FIG. 10, a power supply 270, such as a battery pack or a power converter for a wall outlet for example, provides power to the motor 260, a microprocessor-based controller 275 provides logic to turn on and off the motor 260 on command, and a sensor 281 (best seen by referring to FIG. 1), such as a proximity sensor or infrared sensor for example, is in signal communication with and provides logical signals to the controller 275 when the presence of a user's hand is detected indicating a request for the dispensing of a utensil 125, for example. Other logical signals provided to the controller 275 may be based on the absence of a utensil being available for a user, or removal of the same by a user from a dispensing tray, which will be described in more detail below.

While certain combinations and quantities of drive member, driven members and idlers have been described herein, it will be appreciated that these certain combinations are for illustration purposes only and that any combination of any of the foregoing drive member, driven members and idlers may be employed in accordance with an embodiment of the invention as disclosed herein. Any and all such combinations are contemplated herein and are considered within the scope of the invention disclosed.

While an embodiment of the invention has been described employing a gear-driven dispenser, it will be appreciated that the scope of the invention is not so limited, and that the invention also applies to a dispenser having any other type of drive system suitable for the purposes disclosed herein, such as a belt-drive system or a chain-drive system for example.

Figure 11:
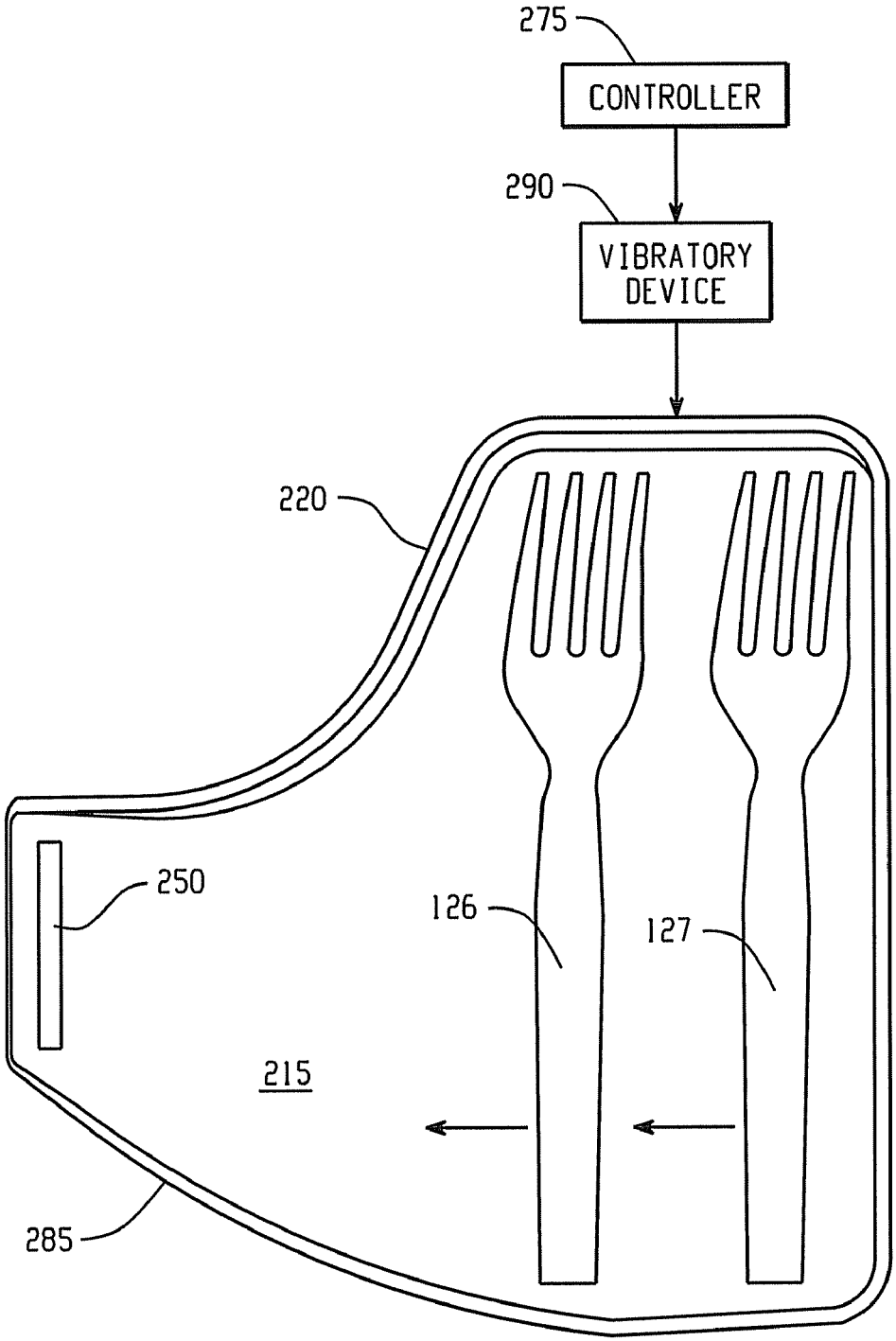
FIG. 11 depicts in plan view a single dispensing tray in accordance with an embodiment of the invention.

As discussed above, an embodiment of the dispenser 100 employs a plurality of dispensing trays 200, 202 (FIGS. 3 and 4) equal in number to the plurality of utensil compartments 120, 122, with one tray being associated with one compartment. Such an arrangement permits side wall 220 (FIGS. 7A and 7B) of each tray to be strategically placed relative to the drop point of a utensil in the associated tray such that the distance from the drop point to the side wall 220 is equidistant in each tray, thereby resulting in a sliding utensil, experiencing a constant acceleration under the influence of gravity, to have a defined impact velocity at the respective side wall 220, which will be substantially the same for each tray, and provide for predicable sliding action. However, it is also contemplated that utilization of a deceleration feature, such as a flatter second dispensing surface 245 (FIG. 8) or a ridge 250 as discussed above, for example, will enable a single dispensing tray to be employed, as depicted in FIG. 11, where a single tray 285 is in dispensing communication with all of the plurality of dispensing compartments (120 and 122 for example), as illustrated by utensils 126 and 127 associated with compartments 122 and 120, respectively (see FIGS. 2 and 5 for similar reference numerals). Here, a first operation of dispensing mechanism 150 would cause the next-to-be-dispensed utensil 126 to drop into tray 285, and a second operation of dispensing mechanism 150 (FIG. 3) would cause the next-in-line utensil 127 to drop into tray 285, with each utensil respectively sliding down the angled dispensing surface 215, impinging side wall 220, and rotating in the manner discussed above to present the holding portion of the utensil to an end user.

In an embodiment, and to assist in a uniform sliding motion of each dispensed utensil 125, a vibratory action may be imparted to any of the aforementioned trays, 200, 202 and 285, by way of any suitable vibratory device 290, such as an electromagnetic or piezoelectric vibrator/buzzer/shaker for example. In an embodiment, the vibratory device 290 is controlled by controller 275 so that the respective tray vibrates in a timed manner in response to a dispense command.

Figure 12:
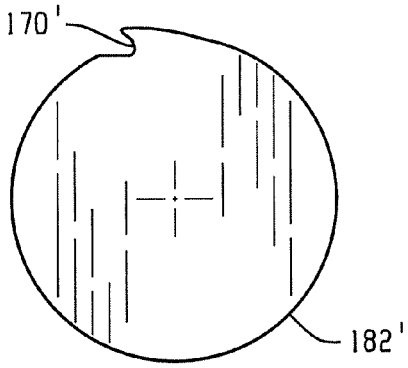
FIGS. 12 and 13 depict in side view dispensing arms of the dispensing mechanism in accordance with embodiments of the invention.
Figure 13:
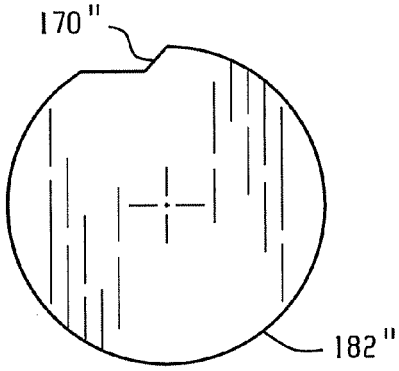

In an embodiment, and with reference to FIGS. 12 and 13, dispensing arm 170 has a specific shape depending on whether dispensing compartments 120, 122 are configured to dispense a knife, fork or spoon. For example, and with reference to FIG. 12, an embodiment includes cam 182' (interchangeable with cam 182) having a dispensing arm 170' shaped with an undercut for dispensing a spoon or a knife. And with reference to FIG. 13, an embodiment includes cam 182" (interchangeable with cam 182) having a dispensing arm 170" shaped with a step oppositely angled to an undercut for dispensing a fork. It will be appreciated that cams 182' and 182" are also interchangeable with cam 180 when rotated 180-degrees so that the respective dispensing arms 170' and 170" are oriented as shown in FIG. 5.

Figure 14:
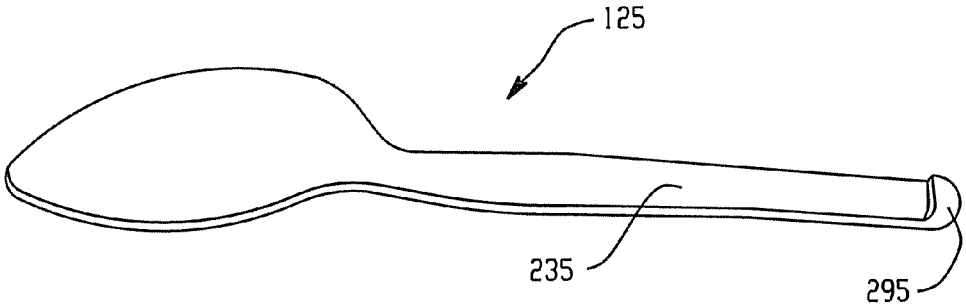
FIGS. 14 and 15 depict in isometric view a cutlery utensil and portion thereof, respectively, for use in accordance with an embodiment of the invention.
Figure 15:
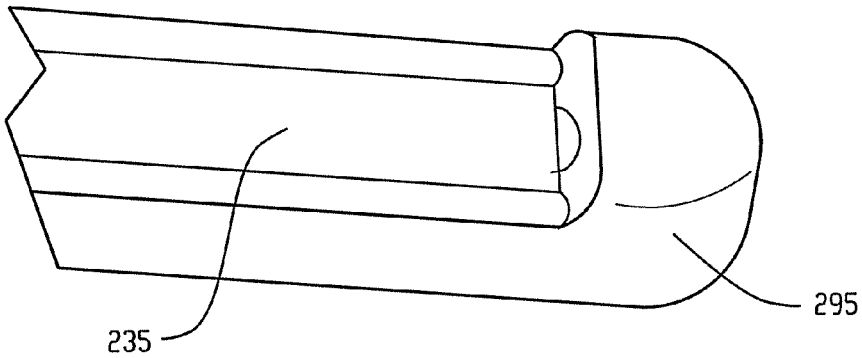

In an embodiment, and with reference to FIGS. 14 and 15, utensil 125 may be configured with a stacking lug 295 disposed at the end of holding portion 235 to assist in more uniform stacking of irregular shaped cutlery designs. That is, stacking lug 295 forms a thicker section at the end of holding portion 235 to separate the holding portions associated with adjacently stacked utensils, one utensil stacked on top of another. While FIGS. 14 and 15 depict a spoon as an exemplary utensil 125 having a stacking lug 295, such a stacking lug can also be present on a knife, fork or spork.

Alternative to the plurality of N dispensing trays 200, 202 (FIG. 2) discussed above, and with reference now to FIG. 16, an embodiment of the invention may also be configured with a single dispensing tray 300. Here, the single dispensing tray 300 is disposed to receive a dispensed utensil 125 from each one of the plurality of N utensil compartments 120, 122 (see FIG. 2), and, similar to the trays 200, 202 discussed above, includes a receiving end 305 disposed to receive a dispensed utensil and a dispensing end 310 disposed to present the dispensed utensil to a user. The dispensing tray 300 includes a first region 315 disposed to cooperate with a holding portion 235 of the dispensed utensil, and a second region 320 disposed to cooperate with a utility portion 240 of the dispensed utensil. The first region 315 has a first dispensing surface 325, and the second region 320 has a second dispensing surface 330, the first dispensing surface 320 being disposed so as to urge the holding portion 235 of the dispensed utensil 125 to slide under the influence of gravity toward the dispensing end 310, while the second dispensing surface 330 retards such sliding action, that is, the second dispensing surface 330 does not promote the same degree of sliding action as does the first dispensing surface 325, thereby causing the dispensed utensil 125 to rotate from a first orientation to a second orientation as the dispensed utensil slides under the influence of gravity, the second orientation being such that holding portion is presented to the user (see FIG. 7B for an illustration of the first and second orientations of a dispensed utensil).

Figure 16:
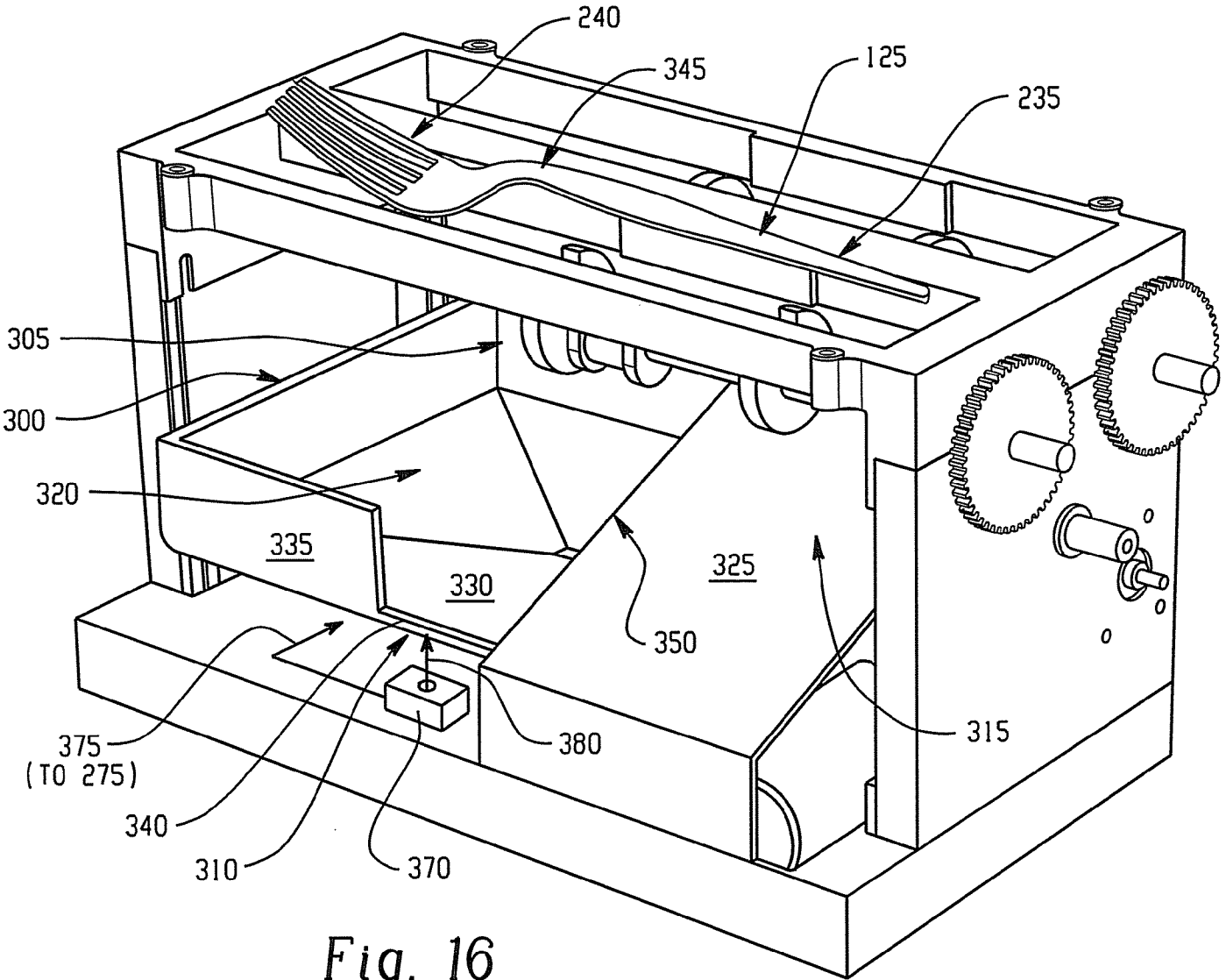
FIG. 16 depicts in isometric view an alternative dispensing tray in accordance with an embodiment of the invention.

In an embodiment, the first dispensing surface 325 comprises a slope that promotes sliding of the holding portion 235 of the dispensed utensil 125 from the receiving end 305 toward the dispensing end 310, and the second dispensing surface 330 comprises a slope that retards such sliding of the utility portion 240 of the dispensed utensil 125 from the receiving end 305 toward the dispensing end 310. As illustrated in FIG. 16, an embodiment includes an arrangement where the slope of the second dispensing surface 330 is opposite in direction (downward slope being inward versus outward) to the slope of the first dispensing surface 325. However, it will be appreciated that the scope of the invention is not so limited and also encompasses an arrangement where the slope of the second dispensing surface 330 is substantially flat, that is, the slope of the second dispensing surface 330 is near or close to zero degrees.

From the foregoing, it will be appreciated that the first and second regions 315, 320 are configured with sliding surfaces that promote differing degrees of slippage, as long as the differing degrees of slippage cause the dispensed utensil 125 to rotate during dispensing to present the holding portion 235 of the dispensed utensil to the end user.

In an embodiment, the second region 320 also includes a partial wall 335 disposed at the dispensing end 310 of the second region 320 to capture the utility portion 240 of the dispensed utensil 125 as the holding portion 235 of the dispensed utensil 125 slides under the influence of gravity toward the dispensing end 310. An opening 340 at the second region 320 is disposed between the partial wall 335 and the first region 315, which is so dimensioned as to permit the user to withdraw the dispensed utensil 125 from the dispenser 100 through the opening 340 by interfacing with the holding portion 235 of the dispensed utensil 125.

By employing the single tray 300 as described above, the combination of sloped ramps 325, 330 will reliably turn a dispensed cutlery utensil 125 independent of variations in frictional forces at the sliding surfaces.

To further assist in reliably turning a dispensed cutlery utensil 125, the center of gravity 345 of a given utensil 125 relative to the left edge 350 of the first dispensing surface 325 is such that the center of gravity 345 is disposed over the second dispensing surface 330 and not over the first dispensing surface 325. That is, as a dispensed utensil 125 drops under the influence of gravity toward the single dispensing tray 300, the center of gravity 345 of the dispensed utensil is positioned over and falls in line with and towards the second dispensing surface 330. Since knives, forks, spoons and sporks naturally may have centers of gravity at different locations along their respective lengths, a dispenser 100 employed for dispensing one type of utensil may have first and second dispensing surfaces 325, 330 with different widths than another dispenser 100 employed for dispensing a different type of utensil. All such dispensers employing first and second dispensing surfaces 325, 330 of different widths are considered within the scope of the invention disclosed herein.

Figure 17:
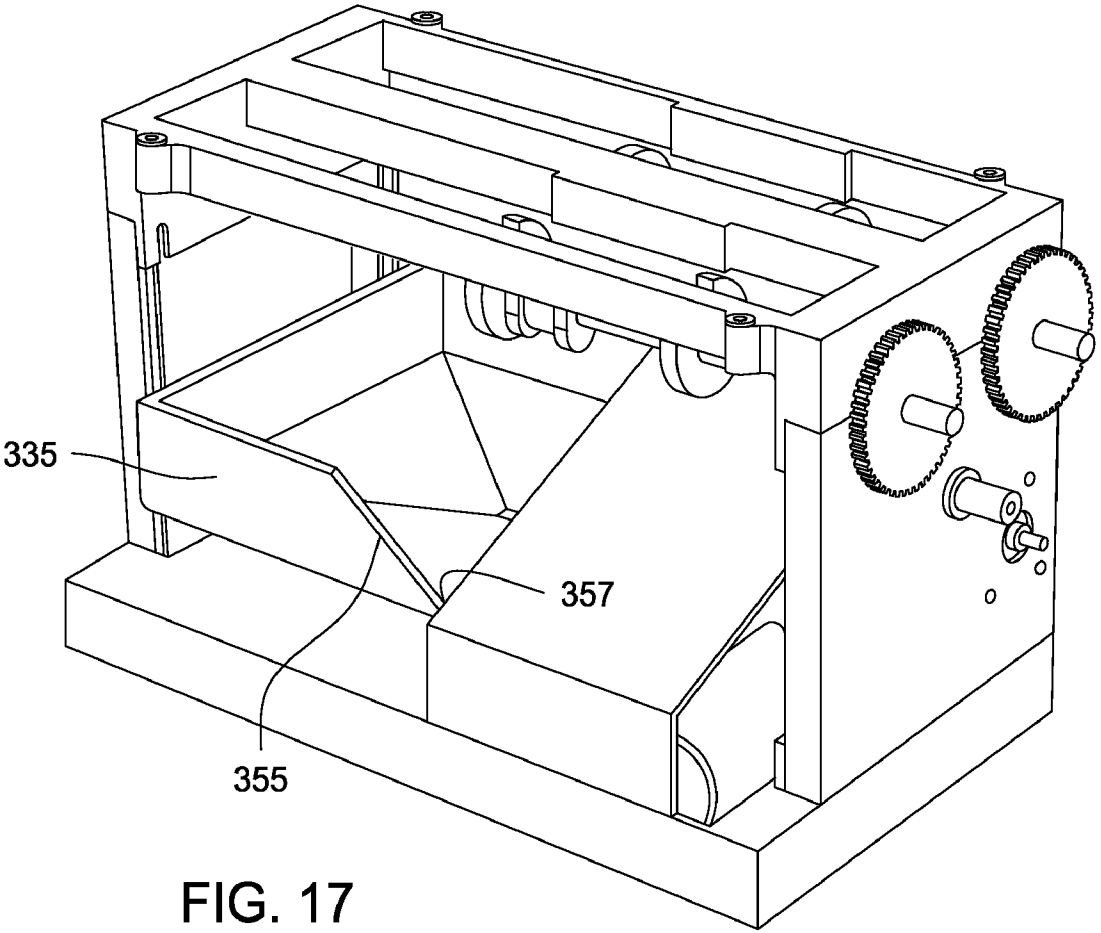
FIGS. 17 and 18 depict in isometric view alternative dispensing trays to that of FIG. 16.
Figure 18:
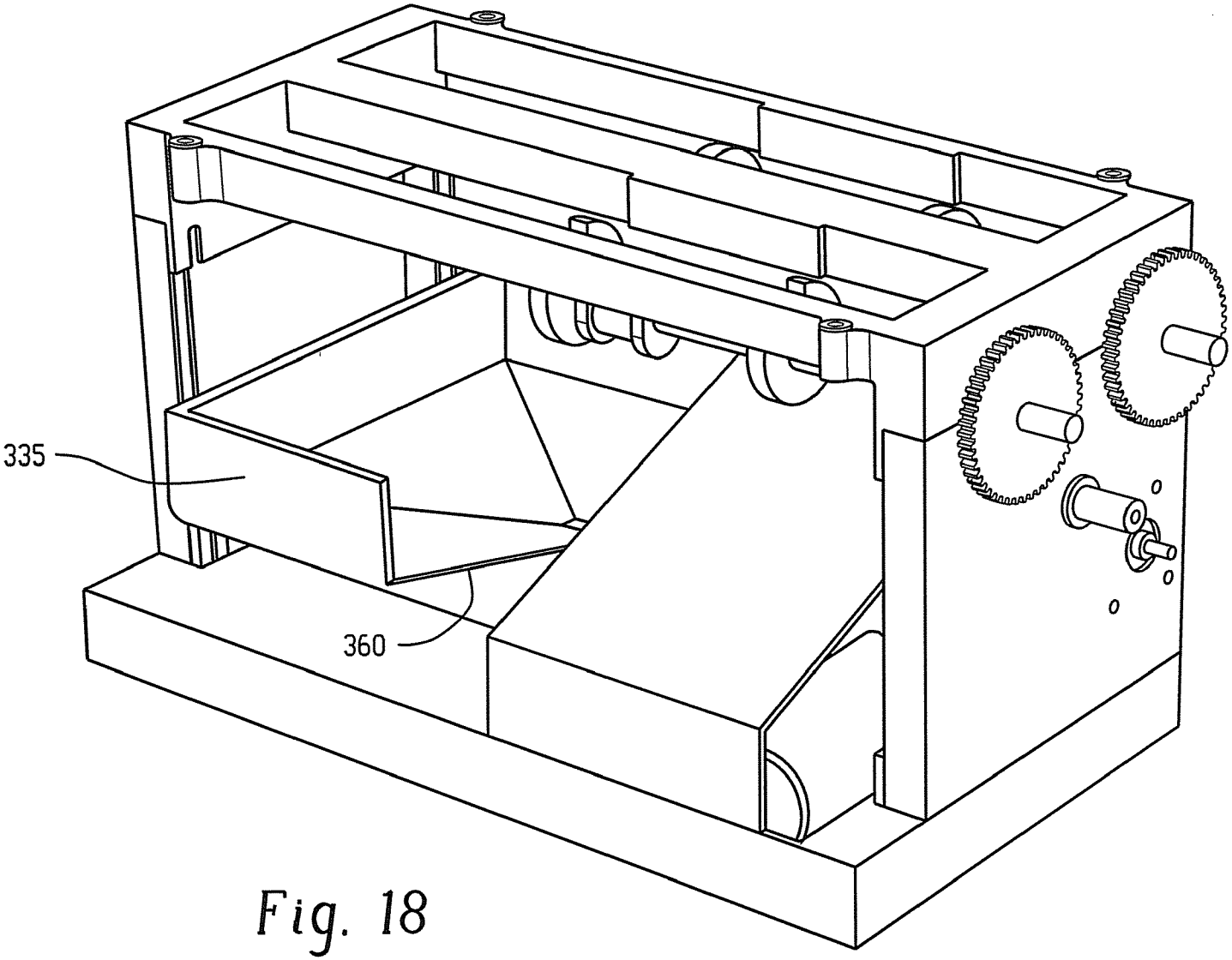

To further assist in accurately positioning the holding portion 235 of a dispensed utensil 125 at the dispensing end 310 of tray 300, and with reference now to FIGS. 16-18 collectively, the partial wall 335 may be configured with sloped surface 355 (FIG. 17) or 360 (FIG. 18) to form a V-type notch 357 for the holding portion 235 of a dispensed utensil 125 to fall into. Such accurate positioning enables dispenser 100 to be equipped with an automated dispensing mechanism that uses a sensor to determine when a utensil has been dispensed. As used herein, the term "V-type notch" means any shaped notch that urges the holding portion 235 of a dispensed utensil 125 toward a defined position (that is, any shaped notch suitable for the purposes disclosed herein), which would include without limitation a flattened V-shaped notch, a U-shaped notch, a flattened U-shaped notch, or a narrow square-shaped notch, for example. The V-type notch may have a symmetrical or asymmetrical geometry.

While an embodiment of the invention has been described employing a manually actuatable lever that rotates about an axis in one revolution increments to operate a gear-driven system of the dispenser, it will be appreciated that the scope of the invention is not so limited, and that the invention also applies to a dispenser having any other operable lever arrangement suitable for the purposes disclosed herein, such as a cantilevered lever that is depressed through a defined amount of displacement, operates a drive system through a pawl-and-ratchet interface, and is spring loaded to return to a detent position ready for another dispensing action.

In addition to the forgoing, an alternative embodiment of the invention includes a controller 275 having a processing circuit (generally depicted by reference numeral 275) responsive to computer executable instructions which when executed on the processing circuit facilitate dispensing of a utensil 125 from a respective one of the utensil compartments 120, 122 by operation of the motor 260 on command.

Figure 19:
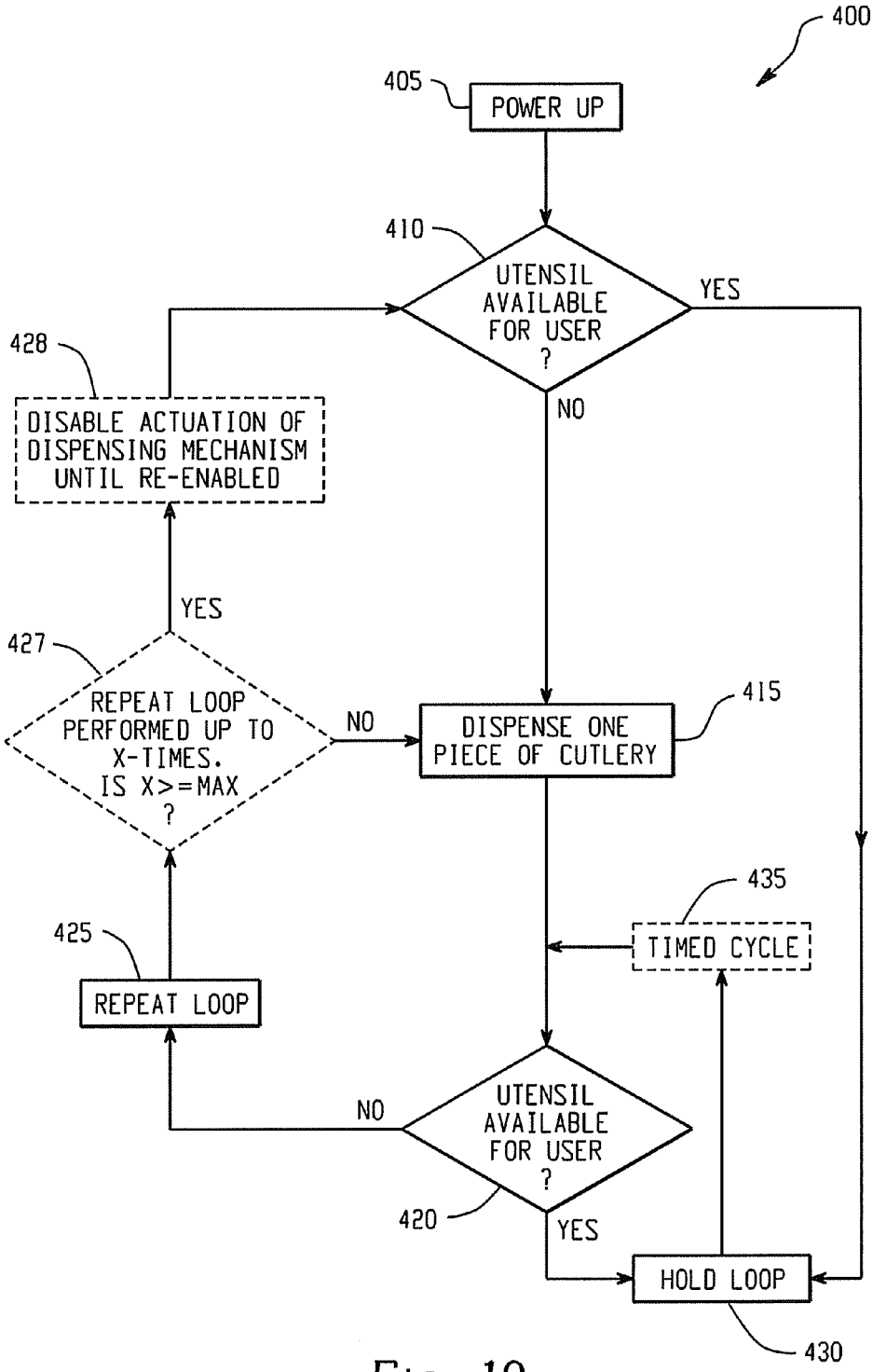
FIGS. 19-22 depict flowcharts of alternative methods in accordance with an embodiment of the invention.
Figure 22:
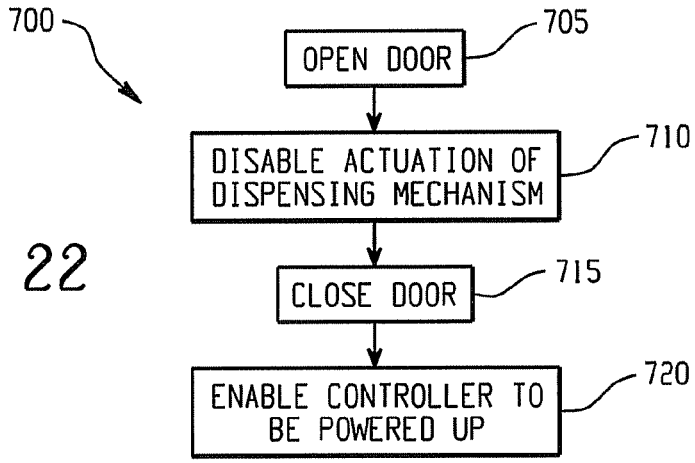

With reference now to FIG. 19, the controller 275 is responsive to computer executable instructions (method 400) when in a powered up state (method block 405). Following a check by a sensor 370 (best seen by referring to FIG. 16) for the availability of a utensil at opening 340 (method block 410), the controller facilitates dispensing of a single piece of cutlery 125 from a respective one of the utensil compartments 120, 122 (method block 415) to the dispensing tray 300. To facilitate automatic dispensing of a next-to-be-dispensed utensil 126 (method block 415), sensor 370 may be an optical sensor, a capacitive sensor, an infrared sensor, or a mechanical switch, for example, disposed and configured to sense a utensil at the dispensing end 310 of the dispensing tray 300 and to generate a dispense command (via signal path 375 depicted in FIG. 16) to the controller 275 to dispense the next-to-be-dispensed utensil 126 upon removal of a utensil 125 from the dispensing tray 300 (method block 420). That is, an embodiment of the invention employs the sensor 370 to sense the presence of a utensil 125 at the dispensing tray 300 (method block 420), and in the absence of such a utensil 125 at the dispensing tray 300 generates a dispense command to the controller 275 to dispense a next-to-be-dispensed utensil 126 (method blocks 425 and 415). Here, an embodiment of the invention works to always have available a utensil 125 to a user without the user having to actively request such a utensil 125. That is, the next-available utensil is ready and waiting for the user to take. As such, the controller 275 is responsive to executable instructions to iteratively repeat (method block 425) the sensing of a utensil at the dispensing tray (method block 420) and the dispensing of a next-to-be-dispensed utensil (method block 415) upon removal of a utensil from the dispensing tray 300. In an alternative embodiment, and with reference to method blocks 427 and 428 depicted in dashed line form in FIG. 19 to illustrate an alternative embodiment, the "repeat loop" (now referred to by method blocks 425, 427 and 428) is performed up to X-times, and if X is greater than or equal to a defined maximum value (Max), such as but not limited to a value of two for example, then the dispensing mechanism 150 is disabled from dispensing or attempting to dispense a utensil until re-enabled (method block 428). Such disabling is advantageous to prevent repeated attempts to dispense a utensil when the utensil compartments 120, 122 are empty. Re-enabling the dispensing mechanism 150 for subsequent dispensing of a utensil is achieved in an embodiment by opening and closing the housing cover 110 (method block 428), which is discussed below in connection with FIG. 22. If a utensil 125 is present at the utensil tray 300 (decision point at method blocks 410 and 420), then controller 275 responds in kind, via recognition of such a condition by sensor 370, to enter into a "hold loop" pattern (method block 430) until the available utensil 125 is removed from the dispensing tray 300. Logic flow from the hold loop (method block 430) passes back to method block 420 for subsequent action, and in doing so may pass through an optional timed cycle process (dashed method block 435) where the checking for the availability of a utensil occurs ten-times per second, for example. Alternative timed cycles may be utilized in accordance with embodiments and purposes disclosed herein.

In an embodiment, the sensor 370 is disposed to sense a utensil 125 at the opening 330 disposed between the partial wall 335 and the first region 315, and in a further embodiment is disposed to sense a utensil resting at a bottom of the V-type notch formed by sloped surface 355 or 360. However, it is envisioned that the sensor 370 may be placed at any practical location to sense the presence or absence of a utensil 125.

In an embodiment, the sensor 370 is an optical sensor disposed to direct a sensor signal 380 in a direction substantially more toward a utensil 125 at the dispensing tray 300 (directed upwards for example) than toward a user requesting a utensil from the dispenser (directed forwards for example), as illustrated in FIG. 16. In an alternative embodiment, the sensor 370 is a mechanical switch, such as a microswitch for example, disposed so as to cause a change of state of the switch in response removal of a utensil 125 from the dispensing tray 300. That is, the microswitch is disposed proximate the bottom of opening 340 (or bottom of V-type notch formed by sloped surface 355 or 360) such that its actuation lever is actuated by the presence (and subsequent removal thereof) of a utensil 125 resting thereat.

Figure 20:
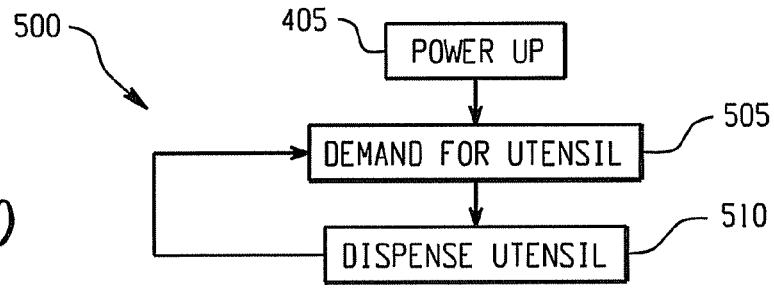

In an alternative embodiment, and with reference now to the method 500 depicted in FIG. 20, the sensor 281 (depicted in FIG. 1) is disposed and configured to sense a request from a user for a utensil (method block 505) and to send a command to the controller for dispensing of a utensil in response to such a request (method block 510), the processing circuit of the controller 275 being responsive to the command to facilitate dispensing of a utensil from the utensil compartment. Here, an embodiment of the invention awaits a command from a user for a piece of cutlery, and responds in kind. In an embodiment, the sensor 281 is any of the foregoing sensors discussed above, and more particularly is a capacitive sensor or an infrared sensor, both of which are well known in the art.

Figure 21:
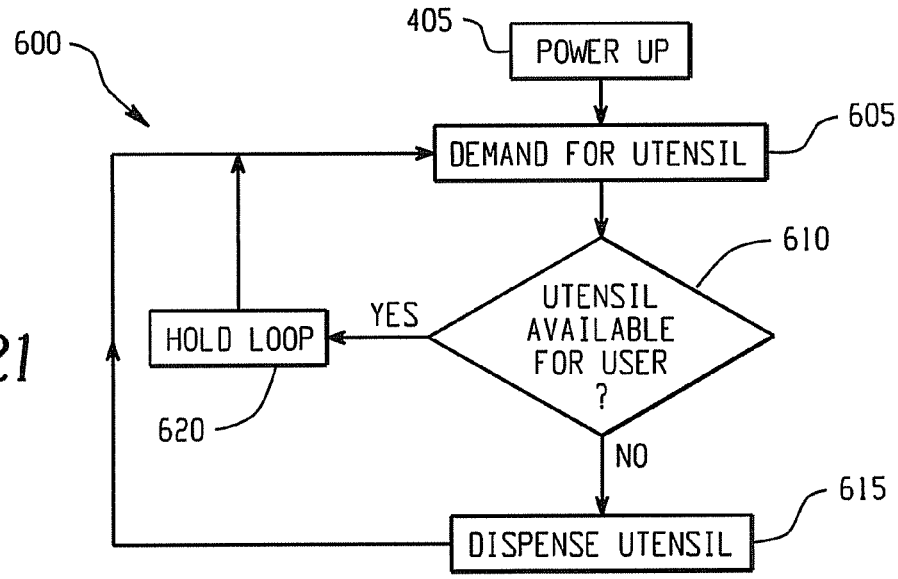

In an alternative embodiment to that of FIG. 20, and with reference now to the method 600 of FIG. 21, an embodiment includes a check (method block 610) via sensor 370 for the availability of a utensil at the dispensing tray 300 prior to dispensing another utensil when a demand signal from sensor 281 is received at controller 275, thereby avoiding a constant false positive reading if a user continues to request a utensil but does not take the one that is present and available at the dispensing tray 300. Following the logic path of method 600, sensor 281 senses a demand for a utensil (method block 605), sensor 370 senses the availability of a utensil ready-and-waiting for a user (method block 610), and the controller 275 facilitates dispensing of a utensil (method block 615) if a utensil is not ready-and-waiting, otherwise controller 275 enters into a hold loop (method block 620) similar to that previously discussed.

In an embodiment, the disable function discussed above in connection with method block 427 in FIG. 19 may also be achieved by the controller 275 switching off power to the motor 260 until a reset command is recognized by the controller 275. In an embodiment, the disable function and the reset command are achieved by a switch 385 (best seen by referring to FIG. 10) that is toggled on/off or off/on (depending on whether a normally open or a normally closed switch is used) by removal and replacement of housing cover 110 with respect to base 280, the switch 385 being disposed in an embodiment for direct interaction with the housing cover 110. That is, and with reference now to method 700 of FIG. 22, when the housing cover 110 is removed ("open door" designation in method block 705), such as for reloading empty utensil compartments 120, 122 for example, the switch 385 is toggled to a change-of-state condition, which causes a signal to be send via signal path 390 to the controller 275. The controller 275 in turn, and in response to computer executable instructions, disables power to the motor 260, which in turn disables actuation of the dispensing mechanism (method block 710), thereby preventing repeated attempts to dispense a utensil when the cover is removed. When the housing cover 110 is replaced ("close door" designation in method block 715), the switch 385 is again toggled to a change-of-state condition to cause a reset command to be registered by the controller 275, which places the controller 275 in a powered up state (method block 720), ready for implementation of the method 400 depicted in FIG. 19. While switch 385 is depicted disposed in a certain location on base 280, it will be appreciated that this is for illustration purposes only, and that switch 385 may be disposed in any location in dispenser 100 suitable for the purposes disclosed herein. For example, an embodiment is contemplated where switch 385 is disposed in a location accessible by maintenance personnel such that a reset command can be registered by the controller 275 and the dispensing mechanism 150 re-enabled without the need to remove/replace the housing cover 110. Another embodiment is contemplated where the switch 385 or the controller 275 is responsive to a wireless signal, such as a radio frequency (RF) or infrared (IR) signal for example, that causes a reset command to be registered with the controller 275, thereby allowing maintenance personnel to negate an erroneous disable condition or to reset the system.

As disclosed, some embodiments of the invention may include some of the following advantages: a cutlery utensil dispenser capable of dispensing cutlery utensils from a plurality of utensil compartments; and, a cutlery utensil dispenser capable of uniformly depleting a plurality of utensil compartments from which the utensils are dispensed. Additionally, some embodiments provide an effective means of hygienically metering cutlery. For example, cutlery that is available via an open container can be contaminated by food, condiments, human contact, and the like, which leads to the cutlery being thrown-away. Embodiments disclosed herein can offer a significant cost savings to the establishment dispensing the cutlery, which can ultimately be shared with the end-user of the cutlery (e.g., a customer in a food service establishment).

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A cutlery utensil dispenser for dispensing cutlery utensils, comprising:

a plurality of utensil compartments, each compartment being so dimensioned and configured to house a stack of utensils, each compartment having a dispensing opening through which a dispensed utensil passes;

a dispensing mechanism comprising a drive member in operable communication with a plurality of driven members, each driven member being associated with a respective one of the compartments, each driven member in operable communication with a shaft having at least one cam surface disposed thereon, each cam surface comprising at least one dispensing arm that facilitates the dispensing of a utensil from its associated compartment; and a plurality of trays, each tray being associated with a respective one of the compartments, each tray having a receiving end disposed to receive a dispensed utensil from only the associated compartment, and a dispensing end;

each tray having an angled dispensing surface such that a dispensed utensil slides under the influence of gravity from the receiving end being wider than the dispensing end with side walls that engage the dispensed utensil to cause the dispensed utensil to rotate from a first orientation to a second orientation as the dispensed utensil slides under the influence of gravity;

wherein actuation of the drive member causes actuation of the driven members, which causes at least one utensil to be dispensed from at least one compartment.

2. The dispenser of claim 1, wherein the plurality of driven members are gear-driven by the drive member.

3. The dispenser of claim 2, wherein one revolution of the drive member causes $(1/N)^x$ revolutions of each driven member, where x is an integer greater than zero and N is an integer from 2 to 5.

4. The dispenser of claim 3, wherein the dispensing arms of each cam surface are circumferentially displaced $(1/N)^x$ intervals of revolution with respect to each other.

5. The dispenser of claim 1, wherein the dispensing arm is a spiral-like profile with a step that is engageable with a next-to-be-dispensed utensil located proximate the associated dispensing opening; the spiral-like profile being configured to retain the next-in-line utensil to prevent out-of-sequence dispensing thereof.

6. The dispenser of claim 1, wherein the plurality of utensil compartments are disposed one adjacent another such that the utensils within each stack of utensils are oriented longitudinally parallel with respect to each other.

7. The dispenser of claim 1, wherein each of the plurality of utensil compartments are so dimensioned and configured to house the same type of utensil.

8. The dispenser of claim 1, wherein each of the plurality of utensil compartments have side openings that provide access to the interior of each of the compartments.

9. The dispenser of claim 1, wherein the actuation of the drive member causes actuation of the driven members, which causes one type of utensil to be dispensed from two or more compartments.

10. The dispenser of claim 1, wherein the actuation of the drive member causes actuation of the driven members, which causes one or more types of utensils to be dispensed from two or more compartments.

11. The dispenser of claim 1, wherein the actuation of the drive member causes actuation of at least one driven member that causes one type of utensil to be dispensed from its associated compartment.

12. The dispenser of claim 1, wherein the actuation of the drive member causes actuation of two or more driven members that causes one type of utensil to be dispensed from two or more compartments either simultaneously or sequentially.

13. The dispenser of claim 1, wherein the actuation of the drive member causes actuation of two or more driven members that causes two or more types of utensils to be dispensed from two or more compartments either simultaneously or sequentially.

14. A cutlery utensil dispenser for dispensing cutlery utensils, comprising:

a plurality of utensil compartments, each compartment being so dimensioned and configured to house a stack of utensils therein, each compartment having a dispensing opening through which a dispensed utensil passes;

a dispensing mechanism comprising a drive member in operable communication with a plurality of driven members, each driven member being associated with at least one compartment, and each driven member in operable communication with a shaft having at least one cam surface disposed therein, each cam surface comprising at least one dispensing arm that facilitates the dispensing of a utensil from the associated compartment;

a plurality of trays, each tray being associated with a respective one of the compartments, each tray having a receiving end disposed to receive a dispensed utensil from only the associated compartment, and a dispensing end;

each tray having an angled dispensing surface such that a dispensed utensil slides under the influence of gravity from the receiving end to the dispensing end, the receiving end being wider than the dispensing end with side walls that engage the dispensed utensil to cause the dispensed utensil to rotate from a first orientation to a second orientation as the dispensed utensil slides under the influence of gravity;

wherein actuation of the drive member causes actuation of the driven members, which causes at least one utensil to be dispensed from at least one compartment;

wherein each of the utensils have a holding portion and a utility portion, and the second orientation is such that holding portion is presented to an end user.

15. The dispenser of claim 14, wherein the second orientation is 90-degrees rotated relative to the first orientation.

16. The dispenser of claim 14, wherein each tray further comprises a second dispensing surface proximate the dispensing end, the second dispensing surface having a flatter surface than the angled dispensing surface such that a dispensed utensil decelerates to a stop as it slides under the influence of gravity from the angled dispensing surface to the flatter surface.

17. The dispenser of claim 14, wherein each tray further comprises a ridge proximate the dispensing end such that a dispensed utensil stops sliding under the influence of gravity in response to impinging the ridge.

18. The dispenser of claim 1, further comprising a manually actuatable lever in operable communication with the drive member, wherein repeated actuation of the lever causes a utensil to be dispensed from each of the plurality of compartments in succession one at a time.

19. The dispenser of claim 1, further comprising a motor in operable communication with the drive member, wherein repeated actuation of the motor causes a utensil to be dispensed from each of the plurality of compartments in succession one at a time.

20. The dispenser of claim 19, further comprising: a sensor in operable communication with a controller; wherein the controller is in operable communication with the motor to cause actuation of the drive member upon receipt of a signal from the sensor.

21. A cutlery utensil dispenser for dispensing cutlery utensils, comprising:

a plurality of utensil compartments, each compartment being so dimensioned and configured to house a stack of utensils therein, each compartment having a dispensing opening through which a dispensed utensil passes;

a dispensing mechanism comprising a drive member in operable communication with a plurality of driven members, each driven member being associated with at least one compartment, and each driven member in operable communication with a shaft having at least one cam surface disposed therein, each cam surface comprising at least one dispensing arm that facilitates the dispensing of a utensil from the associated compartment;

a dispensing tray having a receiving end disposed to receive a dispensed utensil from each of the compartments, and a dispensing end;

the tray having an angled dispensing surface such that a dispensed utensil slides under the influence of gravity from the receiving end to the dispensing end, the receiving end being wider than the dispensing end with side walls that engage a dispensed utensil to cause the dispensed utensil to rotate from a first orientation to a second orientation as the dispensed utensil slides under the influence of gravity, wherein actuation of the drive member causes actuation of the driven members, which causes at least one utensil to be dispensed from at least one compartment.

22. The dispenser of claim 21, further comprising means for decelerating a sliding utensil such that the dispensed utensil stops sliding under the influence of gravity proximate the dispensing end.

23. A cutlery utensil dispenser for dispensing cutlery utensils, comprising:

a plurality of utensil compartments, each compartment being so dimensioned and configured to house a stack of utensils therein, each compartment having a dispensing opening through which a dispensed utensil passes;

a dispensing mechanism comprising a drive member in operable communication with a plurality of driven members, each driven member being associated with at least one compartment, and each driven member in operable communication with a shaft having at least one cam surface disposed therein, each cam surface comprising at least one dispensing arm that facilitates the dispensing of a utensil from the associated compartment;

a dispensing tray disposed to receive a dispensed utensil from each one of the plurality of utensil compartments;

the dispensing tray having a receiving end disposed to receive a dispensed utensil and a dispensing end disposed to present the dispensed utensil to a user;

the dispensing tray having a first region disposed to cooperate with a holding portion of the dispensed utensil, and a second region disposed to cooperate with a utility portion of the dispensed utensil;

the first region having a first dispensing surface, and the second region having a second dispensing surface, the first dispensing surface disposed so as to urge the holding portion of the dispensed utensil to slide under the influence of gravity toward the dispensing end while the second dispensing surface retards such sliding action, thereby causing the dispensed utensil to rotate from a first orientation to a second orientation as the dispensed utensil slides under the influence of gravity, the second orientation being such that holding portion is presented to the user;

wherein actuation of the drive member causes actuation of the driven members, which causes at least one utensil to be dispensed from at least one compartment.

24. The dispenser of claim 23, wherein:

the first dispensing surface comprises a slope that promotes sliding of the holding portion of the dispensed utensil from the receiving end toward the dispensing end;

the second dispensing surface comprises a slope that retards such sliding of the utility portion of the dispensed utensil from the receiving end toward the dispensing end.

25. The dispenser of claim 24, wherein: the slope of the second dispensing surface is opposite in direction to the slope of the first dispensing surface.

26. The dispenser of claim 23, wherein: the second region comprises a partial wall disposed at the dispensing end of the second region to capture the utility portion of the dispensed utensil as the holding portion of the dispensed utensil slides under the influence of gravity toward the dispensing end.

27. The dispenser of claim 26, wherein: the second region comprises an opening disposed between the partial wall and the first region, the opening being so dimensioned as to permit the user to withdraw the dispensed utensil from the dispenser by interfacing with the holding portion of the dispensed utensil.

28. The dispenser of claim 26, wherein: the opening comprises a V-type notch.

29. The dispenser of claim 23, wherein: the first dispensing surface and the second dispensing surface are disposed such that a center of gravity of the dispensed utensil is positioned over the second dispensing surface such that the center of gravity falls in line with and towards the second dispensing surface under the influence of gravity.

30. A cutlery utensil dispenser for dispensing cutlery utensils, comprising:

a plurality of utensil compartments, each compartment being so dimensioned and configured to house a stack of utensils therein, each compartment having a dispensing opening through which a dispensed utensil passes;

a dispensing mechanism comprising a drive member in operable communication with a plurality of driven members, each driven member being associated with at least one compartment, and each driven member in operable communication with a shaft having at least one cam surface disposed therein, each cam surface comprising at least one dispensing aim that facilitates the dispensing of a utensil from the associated compartment;

a dispensing tray disposed to receive a dispensed utensil from each one of the plurality of utensil compartments;

the dispensing tray having a receiving end disposed to receive a dispensed utensil and a dispensing end disposed to present the dispensed utensil to a user;

the dispensing tray having a first region disposed to cooperate with a holding portion of the dispensed utensil, and a second region disposed to cooperate with a utility portion of the dispensed utensil;

the first and second regions comprising sliding surfaces that promote differing degrees of slippage of the dispensed utensil sliding under the influence of gravity, such that the differing degrees of slippage cause the dispensed utensil to rotate during dispensing to present the holding portion of the dispensed utensil to the end user;

wherein actuation of the drive member causes actuation of the driven members, which causes at least one utensil to be dispensed from at least one compartment.

31. A cutlery utensil dispenser for dispensing cutlery utensils, comprising:

a utensil compartment;

a dispensing mechanism in operable communication with the utensil compartment;

an electric motor in operable communication with the dispensing mechanism;

a controller in operable communication with the motor, the controller having a processing circuit responsive to computer executable instructions which when executed on the processing circuit facilitates dispensing of a utensil from the utensil compartment by operation of the motor and the dispensing mechanism on command;

a dispensing tray disposed to receive a dispensed utensil;

the dispensing tray having a receiving end disposed to receive a dispensed utensil from the utensil compartment, and a dispensing end;

the dispensing tray having an angled dispensing surface such that a dispensed utensil slides under the influence of gravity from the receiving end to the dispensing end, the receiving end being wider than the dispensing end with side walls that engage the dispensed utensil to cause the dispensed utensil to rotate from a first orientation to a second orientation as the dispensed utensil slides under the influence of gravity;

a sensor disposed and configured to sense a utensil at the dispensing tray and to generate the command to the controller to dispense a next-to-be-dispensed utensil upon removal of a utensil from the dispensing tray; and wherein the controller dispenses a single piece of cutlery from the utensil compartment in response to a piece of cutlery not being available for a user at a dispensing tray of the dispenser.

32. A method of automatically dispensing a single piece of cutlery utensil from an electronically controlled and motor driven cutlery utensil dispenser, comprising:

using a sensor to sense a presence of a piece of cutlery at a dispensing tray of the dispenser and automatically dispensing a single piece of cutlery to the dispensing tray for subsequent removal by a user in response to a piece of cutlery not being present at the dispensing tray, wherein the tray has dispensing end and a receiving end disposed to receive the single piece of cutlery from a utensil compartment, and wherein the tray has an angled dispensing surface such that the dispensed single piece of cutlery slides under the influence of gravity from the receiving end to the dispensing end, the receiving end being wider than the dispensing end with side walls that engage the dispensed utensil to cause the dispensed single piece of cutlery to rotate from a first orientation to a second orientation as the dispensed single piece of cutlery slides under the influence of gravity;

using the sensor to sense a presence of the dispensed cutlery at the dispensing tray prior to removal by a user; and in response to the sensor sensing removal of the dispensed cutlery from the dispensing tray, dispensing a next-to-be-dispensed single piece of cutlery to the dispensing tray for subsequent removal by a user.

33. The method of claim 32, further comprising:

repeating, in order, the steps of:

using the sensor to sense a presence of the dispensed cutlery at the dispensing tray prior to removal by a user; and in response to the sensor sensing removal of the dispensed cutlery from the dispensing tray, dispensing a next-to-be-dispensed single piece of cutlery to the dispensing tray for subsequent removal by a user.

34. A cutlery utensil dispenser for dispensing cutlery utensils, comprising:

a utensil compartment so dimensioned and configured to house a stack of cutlery utensils;

a dispensing mechanism disposed and configured to facilitate dispensing of a utensil from the utensil compartment on command;

means for providing electrical power, and an electric motor in operable communication with the means for providing electrical power and the dispensing mechanism;

a controller in operable communication with the motor, the controller having a processing circuit responsive to computer executable instructions which when executed by the processing circuit facilitates dispensing of a utensil from the utensil compartment by operation of the motor on command;

a dispensing tray disposed to receive a dispensed utensil;

the tray having a receiving end disposed to receive a dispensed utensil from the utensil compartment, and a dispensing end;

the tray having an angled dispensing surface such that a dispensed utensil slides under the influence of gravity from the receiving end to the dispensing end, the receiving end being wider than the dispensing end with side walls that engage the dispensed utensil to cause the dispensed utensil to rotate from a first orientation to a second orientation as the dispensed utensil slides under the influence of gravity;

a sensor disposed and configured to sense a utensil at the dispensing tray and to generate the command to the controller to dispense a next-to-be-dispensed utensil upon removal of a utensil from the dispensing tray;

wherein the controller dispenses a single piece of cutlery from the utensil compartment in response to a piece of cutlery not being available for a user at a dispensing tray of the dispenser.

35. The dispenser of claim 34, wherein:

the utensil compartment is one of a plurality of utensil compartments, each compartment being so dimensioned and configured to house a stack of utensils, each compartment having a dispensing opening through which a dispensed utensil passes;

the dispensing mechanism comprises a drive member in operable communication with a plurality of driven members, each driven member being associated with a respective one of the compartments, each driven member in operable communication with a shaft having at least one cam surface disposed therein, each cam surface comprising at least one dispensing arm that facilitates the dispensing of a utensil from the associated compartment;

actuation of the drive member by the motor causes actuation of the driven members which causes at least one utensil to be dispensed from at least one compartment.

36. The dispenser of claim 34, wherein:

the controller is further responsive to executable instructions which when executed on the processor iteratively repeats the sensing of a utensil at the dispensing tray and the dispensing of a next-to-be-dispensed utensil upon removal of a utensil from the dispensing tray.

37. The dispenser of claim 34, wherein: prior to the dispensing of a single piece of cutlery, the sensor generates the command to the controller to dispense a utensil upon sensing an absence of a utensil at the dispensing tray.

38. The dispenser of claim 34, further comprising:

a sensor disposed and configured to sense a request from a user for a utensil and to send a command to the controller for dispensing of a utensil in response to the request, the processing circuit of the controller being responsive to the command to facilitate dispensing of a utensil from the utensil compartment.

39. The dispenser of claim 38, wherein the sensor comprises a capacitive sensor or an infrared sensor.

40. The dispenser of claim 34, wherein the sensor comprises an optical sensor, a capacitive sensor, an infrared sensor, or a mechanical switch.

41. The dispenser of claim 40, the sensor is disposed to sense a utensil at the dispensing end.

42. The dispenser of claim 41, wherein:

the dispensing tray comprises a first region disposed to cooperate with a holding portion of the dispensed utensil, and a second region disposed to cooperate with a utility portion of the dispensed utensil;

the second region comprises a partial wall disposed at the dispensing end of the second region to capture the utility portion of the dispensed utensil as the holding portion of the dispensed utensil moves under the influence of gravity toward the dispensing end;

the second region comprises an opening disposed between the partial wall and the first region, the opening being so dimensioned as to permit the user to withdraw the dispensed utensil from the dispenser by interfacing with the holding portion of the dispensed utensil;

the sensor is disposed to sense a utensil at the opening.

43. The dispenser of claim 42, wherein: the opening comprises a V-type notch; the sensor is disposed to sense a utensil resting at a bottom of the V-type notch.

44. The dispenser of claim 40, wherein: the sensor is a mechanical switch disposed so as to cause a change of state of the switch in response removal of a utensil from the dispensing tray.

45. The dispenser of claim 40, wherein:

the sensor is an optical sensor disposed to direct a sensor signal in a direction substantially more toward a utensil at the dispensing tray than toward a user requesting a utensil from the dispenser.

46. The dispenser of claim 45, wherein:

the dispensing tray comprises a first region disposed to cooperate with a holding portion of the dispensed utensil, and a second region disposed to cooperate with a utility portion of the dispensed utensil;

the second region comprises a partial wall disposed at the dispensing end of the second region to capture the utility portion of the dispensed utensil as the holding portion of the dispensed utensil moves under the influence of gravity toward the dispensing end;

the second region comprises a V-type notch opening disposed between the partial wall and the first region, the opening being so dimensioned as to permit the user to withdraw the dispensed utensil from the dispenser by interfacing with the holding portion of the dispensed utensil;

the sensor is disposed to sense a utensil at the V-type notch opening.

* * * * *